US007303162B2

(12) United States Patent
Burke et al.

(10) Patent No.: US 7,303,162 B2
(45) Date of Patent: Dec. 4, 2007

(54) CORD HOLDER APPARATUS

(76) Inventors: Donald D. Burke, 9719 N. Flora, Kansas City, MO (US) 64155; Cynthia A. Burke, 9719 N. Flora, Kansas City, MO (US) 64155

( * ) Notice: Subject to any disclaimer, the term of this patent is extended or adjusted under 35 U.S.C. 154(b) by 0 days.

(21) Appl. No.: 10/947,098

(22) Filed: Sep. 22, 2004

(65) Prior Publication Data

US 2005/0077411 A1 Apr. 14, 2005

Related U.S. Application Data

(60) Provisional application No. 60/504,941, filed on Sep. 22, 2003, provisional application No. 60/514,058, filed on Oct. 25, 2003.

(51) Int. Cl.
*B65H 75/38* (2006.01)

(52) U.S. Cl. ..... 242/405.2; 242/388.1; 206/409

(58) Field of Classification Search ..... 242/388, 242/388.1, 388.5, 388.6, 405.1, 129, 398, 242/405.2, 405.3; 206/409, 702; 254/134.3 R
See application file for complete search history.

(56) References Cited

U.S. PATENT DOCUMENTS

| | | | | | |
|---|---|---|---|---|---|
| 1,983,565 | A * | 12/1934 | Replogle | ..... | 242/388.1 |
| 2,428,446 | A * | 10/1947 | Beede | ..... | 242/381.6 |
| 3,838,830 | A * | 10/1974 | Pettit | ..... | 242/395 |
| 4,244,493 | A * | 1/1981 | Harrison | ..... | 221/46 |
| 4,653,833 | A * | 3/1987 | Czubernat et al. | ..... | 439/528 |
| 5,992,787 | A * | 11/1999 | Burke | ..... | 242/388.1 |
| 6,199,784 | B1 * | 3/2001 | Wang et al. | ..... | 242/378 |
| 2002/0145073 | A1 * | 10/2002 | Swanson et al. | ..... | 242/588.3 |
| 2003/0038209 | A1 * | 2/2003 | Remeczky | ..... | 242/610.6 |

* cited by examiner

*Primary Examiner*—Peter M. Cuomo
*Assistant Examiner*—William E Dondero
(74) *Attorney, Agent, or Firm*—Shughart Thomson & Kilroy PC

(57) ABSTRACT

A cord storage device is provided which allows the simultaneous winding and unwinding of both halves of a cord while maintaining both cord ends in position for use and the device also permits unwinding of the cord from the storage device while one cord end is held in a fixed position.

16 Claims, 29 Drawing Sheets

SECTION A-A

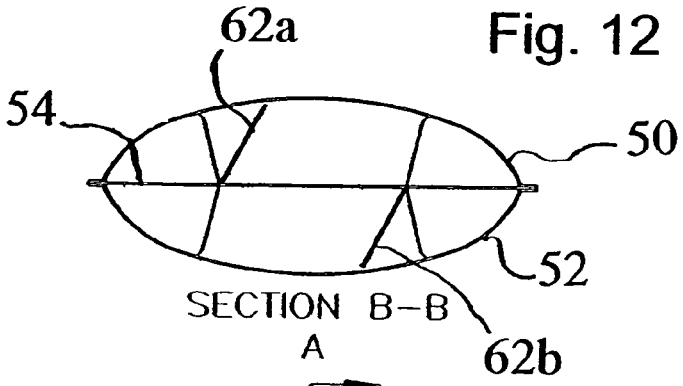
Fig. 12
Fig. 13
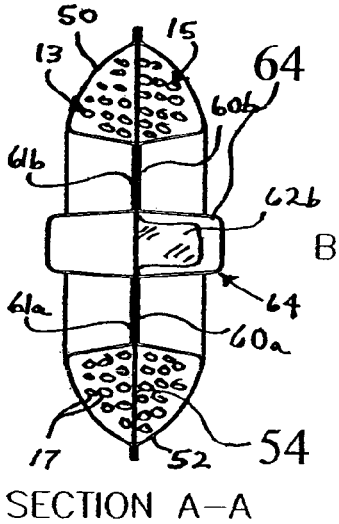
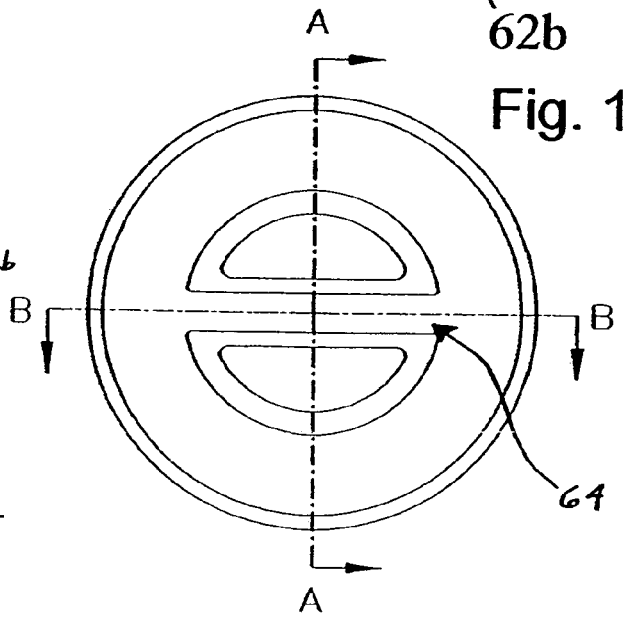
Fig. 14
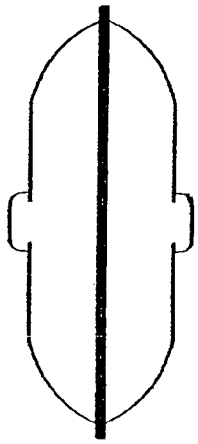
Fig. 15
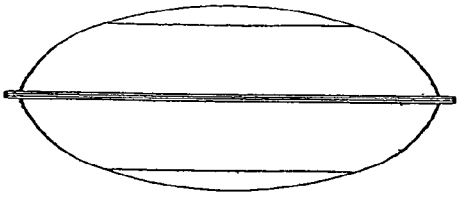
Fig. 16

Fig. 29
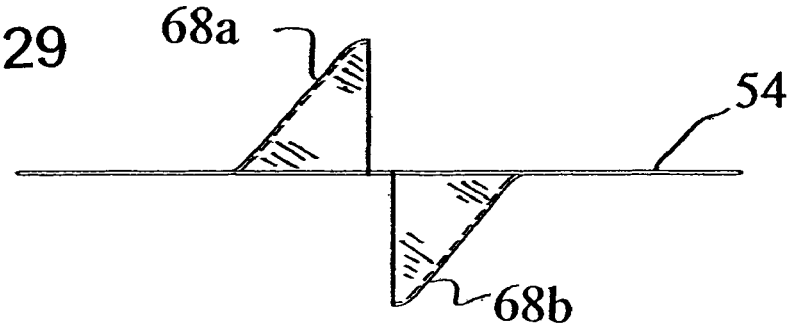
Fig. 30
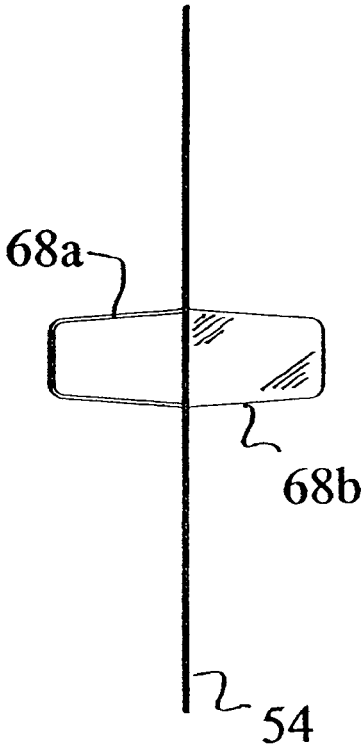
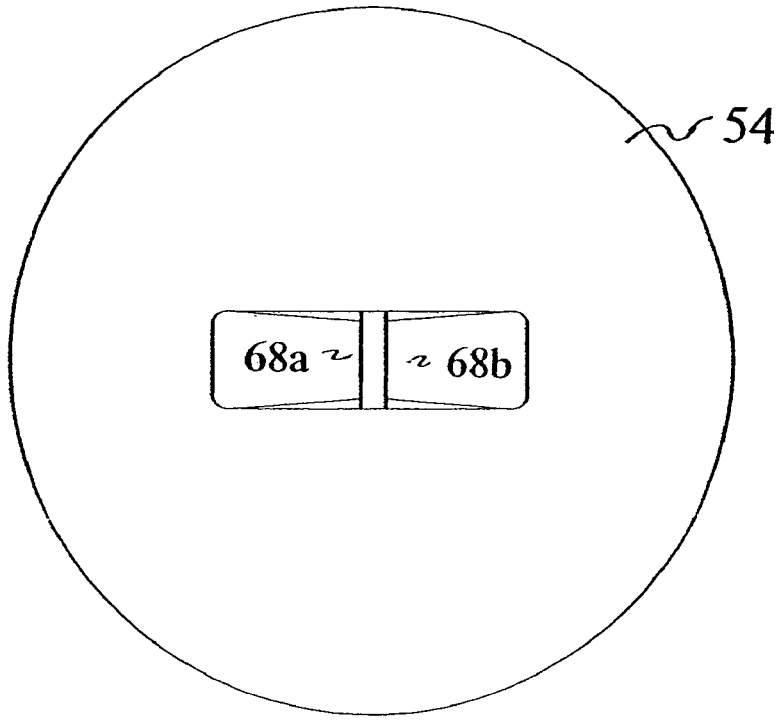
Fig. 31

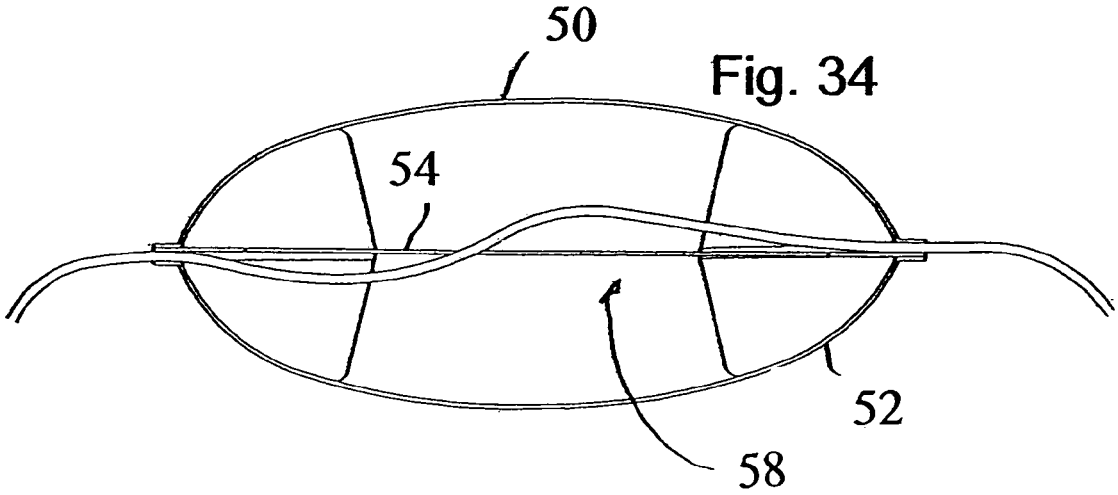
Fig. 34
Fig. 35
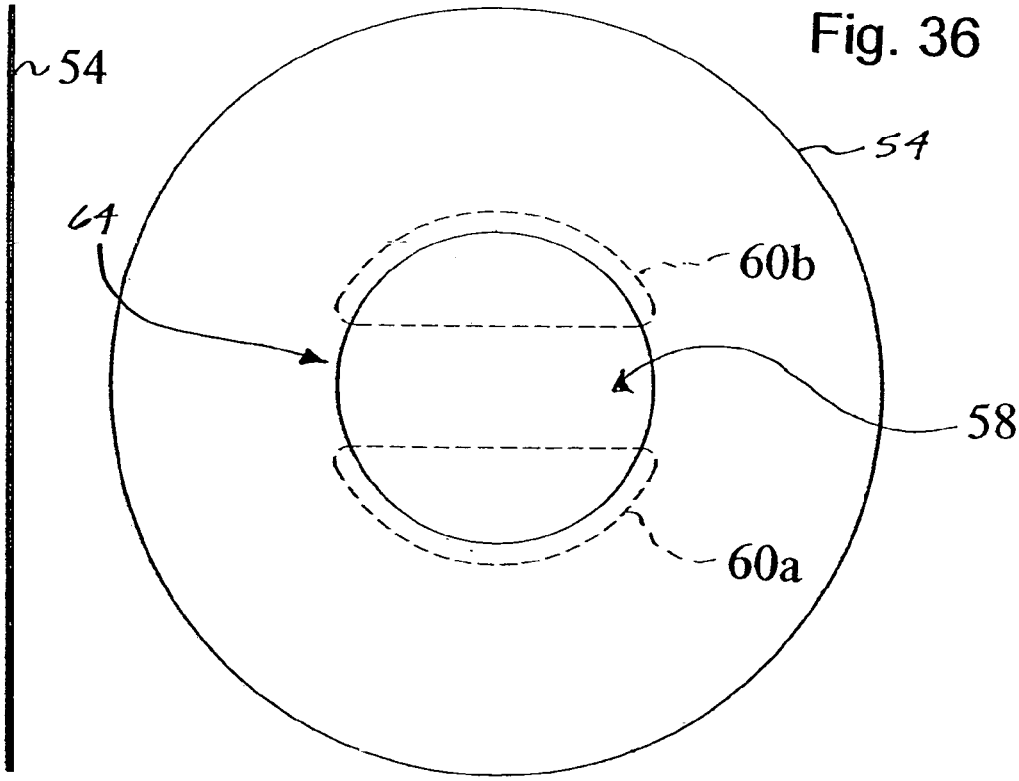
Fig. 36

75
17
54a
54b 75
17
78
54
54b
73
54a

15
R
R
17

78
17

CORD HOLDER APPARATUS

CONTINUATION DATA

This application claims priority to provisional application Ser. No. 60/504,941 filed Sep. 22, 2003 and to provisional application Ser. No. 60/514,058 filed Oct. 25, 2003.

FIELD OF THE INVENTION

The present invention relates generally to devices to hold cord and the like such as computer cords, power cords or any line or cord piece. More particularly, the present invention relates to dividers and cord holder shells that are used to separate a cord into two, separately accessible ends which may be individually wound on the storages device and individually unwound.

BACKGROUND OF THE INVENTION

This invention relates to devices for storing cords such as electrical extension cords or appliance cords. Particularly, this invention relates to a device for maintaining such cords in a compact, untangled manner and for providing both cord halves and ends available and ready for instant and individual or simultaneous extension and use, as shown in U.S. Pat. No. 5,992,787 to Burke the specification of which is incorporated herein by reference.

The convenient storage and use of electrical extension cords, electrical cords, and other such lines and cords is a continuing problem. With extension cords in particular it is desirable, if not required, to access both ends of the cord during use. Previous holders for such cords solve this problem, generally, by one of two methods: first, the fixing of one end of the cord to the exterior of a cord holder device while the remainder of the cord is wound on the device; or second, the fixing of the middle of the cord on a holder device and winding, simultaneously, both ends of the cord onto the holder.

In the first method, the utility of the cord is limited as one end of the cord is fixed to the holder and can not be conveniently moved. Where the male end of the cord is attached to the holder, the holder becomes an additional impediment to connecting the male end of the cord to a partially blocked or distant outlet. Alternatively, where the female end of the cord is attached to the holder, the holder becomes an albatross to which the cord of the electric appliance is anchored.

In the second method, the winding and free uncontrolled unwinding of the cord from the device results in tangling of the cord with itself on the device. The result is a cord which becomes knotted with itself on the device. This requires repeated untangling of the cord during subsequent unwinding. In addition, such devices tend to be bulky and inconvenient to carry on the job and to transport. Examples of various types of cord storage devices may be found in issued patents.

Examples of devices which simply wind a cord about an elongate axis are Sims, Jr., U.S. Pat. No. 3,907,236; Gruenewald, U.S. Pat. No. 4,177,961; Sandberg et al., U.S. Pat. No. 4,261,529; Brown, U.S. Pat. No. 4,586,675; Hu, U.S. Pat. No. 4,778,125; and Lilley, Jr., U.S. Pat. No. 5,129,514. These patents teach devices for winding a cord around an unenclosed device having an elongate axis. However, none of these patents teach or suggest the separation of a cord into cord-portions for storage in separate storage compartments to make available both cord ends for use and to allow both independent and simultaneous winding and unwinding of the cord-portions. In all of these patents one cord end is fixed to the housing, and therefore, they teach against making both cord ends available to the user.

Examples of patented devices which teach the winding of a cord onto a central hub and which is, generally, not enclosed are Jaworowski et al., U.S. Pat. No. 2,603,429; Schinske, U.S. Pat. No. 3,355,123; Wilson, U.S. Pat. No. 3,388,876; Hindenburg, U.S. Pat. No. 3,533,599; and Van Skiver, U.S. Pat. No. Des. 314,910. These patents, except VanSkiver, teach the winding of a cord from one end to the other end about a drum or central hub thereby presenting only one end of the cord for use. None of these patents teach separation of cord-portions into different storage compartments to present both cord ends for individual or simultaneous use.

The VanSkiver reference varies from the above teaching in that it appears to present a hook attached to the single storage area about the central hub. This hook may be used to secure one end of a cord or may allow for the attachment of a mid-section of a cord near the hub. This would allow the formed cord halves to be wound onto the device to present both ends of the cord for use. However, VanSkiver does not divide the cord into separated storage compartments to permit separated storage and individual winding and unwinding of either cord end for use. It is the unseparated storage of VanSkiver which causes the problem of entanglement between the cord-portions as they are wound on and off the device. This type of storage requires the user to frequently stop unwinding and manually separate the tangled cord. The present invention solves this problem and presents both cord ends for both independent and simultaneous unwinding by the user.

Other cord devices have a central hub for winding a cord thereon with the cord storage area having walls which, to different degrees, enclose the storage area. Examples of patents showing such devices are Sweeney, U.S. Pat. No. 3,430,886; Berger et al., U.S. Pat. No. 3,648,949; Carpentier, U.S. Pat. No. 3,840,713; Finlayson et al., U.S. Pat. No. 3,959,608; McKinnon et al., U.S. Pat. No. Des. 248,010; Eaton, U.S. Pat. No. 4,685,636; and Mansfield, U.S. Pat. No. 4,872,622. None of these references teach or suggest separation of a cord into cord-portions for separated storage to provide both cord ends for use and to allow both independent and simultaneous winding and unwinding of the cord-portions. In all of these references, except Eaton, one cord end is either fixed to the housing or is wound against the hub, and therefore, they teach against making both cord ends available to the user. In Eaton, two wire ends protrude from the device as a result of a specific method for loading wire onto the reel and the specific manner of making wire harnesses taught by Eaton.

The patent to Mansfield teaches a device for winding a cord thereon for later opening of the device to allow removal of the cord as a wound unit. Though the cord may be used while on the Mansfield device, one cord end is fixed at (23) to the inside central opening (17) of the Mansfield device. Mansfield teaches against the present invention in that it fixes one cord end to the device thereby preventing unwinding of that end from the device. Mansfield further teaches against the present invention as the Mansfield device is intended to provide and teaches the use of a single compartment so that the wound cord may be removed from the device as a bundle upon taking the device apart. The Mansfield device is open to entry of dirt and moisture and is intended to be disassembled for removal of the cord as a whole.

Finally, designers of cord reel and storage devices have added moving parts which are intricate and must be precision manufactured and contain various bearing surfaces to permit smooth operation. Examples of such devices can be found in the patents to Replogle, U.S. Pat. No. 1,692,517; Replogle, U.S. Pat. No. 1,983,565; Von Voorn, U.S. Pat. No. 2,952,420; Kasa, U.S. Pat. No. 3,782,654; Gaul, U.S. Pat. No. 3,809,331; Aragon, U.S. Pat. No. 4,150,798 and Chaconas et al., U.S. Pat. No. 4,489,902.

The devices of these patents are cord storage devices having either two housing portions which must rotate against each other, or an internal rotating divider, or both. The storage compartment of these devices is split into two cord storage areas with the cord passing into both areas for storage. None of these patents teach or suggest a device which eliminates the use of moving parts and bearing surfaces and winding handles while achieving separation of a cord into two cord-portions to present both cord ends for use and to allow both independent and simultaneous winding and unwinding of the cord-portions.

The present invention eliminates these moving parts while accomplishing the above-stated benefits. All of the devices in the last-above group require intricate and precision molded part construction and complicated assembly by the manufacturer or user thus resulting in an expensive product. All of these devices require bearing surfaces due to the rotation of device parts. This presents the opportunity for substantial friction between moving parts and drag on the cord.

All the devices of this group require equal amounts of cord to be simultaneously wound or unwound from the device. None of these devices teach or suggest how a user might have access to either cord-portion independently of the other thereby allowing differential winding and unwinding of the two cord-portions. In fact, these references teach against the independent operation of each cord half by making winding and unwinding of the two cord-portions a result of the movement of the same parts of the device. Thus independent utilization of a single cord-portion cannot occur in these devices.

Further, none of the devices of this group are capable of loading a cord or changing cords on the device without complete disassembly of the device. Also, none of the devices of this group allow for complete concealment of the cord and cord ends within the device to exclude dirt and moisture from the cord storage area.

A particular example is U.S. Pat. No. 2,952,420 to Von Hoorn in which a cord is separated within a reel by a divider. Von Hoorn, however, presents several drawbacks which are overcome in the present invention. Specifically, the Von Hoorn device incorporates a housing of two pieces which must rotate against each other to unwind and rewind the cord and which requires the cord to travel in and out of slots in the housing, and it relies on a finger-hold means for the rewinding operation. Thus, the Von Horn device requires precision casting or molding during manufacture making the device expensive to produce. Importantly, the Von Hoorn device must be disassembled to load a cord into the device as the Von Hoorn device does not have flexible outer walls allowing user access to the storage areas of the device. The Von Hoorn device presents substantial frictional resistance during operation by the rotating bearing surfaces and the cord rubbing against the access slots. Importantly, since the cord in the Von Hoorn device is mounted on a rotating reel, a user must pull on both ends of the cord at once, and equal amounts of the cord must be extracted from the holder to avoid binding of the cord within the device. The Von Hoorn device does not allow independent winding and unwinding of the two ends of the cord.

Therefore, a long need has existed for a cord reel and storage device which permits user access to both ends of the cord while permitting removal of either or both ends of the cord from the reel either simultaneously or individually and which can allow one end of the cord to be fixed in place while the cord reel is operated to unwind the cord from storage on the device and which permits the cord and cord ends to be fully captured and concealed within the storage device to protect the cord from dirt and moisture and which allows a user to load a new cord or change-out the old cord without the need to dismantle the device and which prevents the free, uncontrolled unwinding of the cord from the reel and which can accomplish all these benefits while eliminating the need for moving parts and bearing surfaces and precision molded and intricate parts.

SUMMARY OF THE INVENTION

The objectives of the present invention include providing a cord storage device which permits rapid winding and unwinding of the two ends of a cord while avoiding tangling of the cord and while eliminating moving parts.

A principle object of the invention is to provide, within a single cord holding device, the ability for a user to separately and individually wind and unwind either end of a cord with respect to the other end of the cord, and a device which also permits a user to simultaneously wind and unwind both ends of the cord.

It is another object of the device to provide a cord storage device which allows both ends of the cord to be independently available for use and does not require equal payout to take-up the cord ends during use.

Yet another object of the present invention is to allow unwinding of the cord from the device while one end of the cord is fixed in place.

Another object of the present invention is to provide unwinding of both ends of the cord from the device by a user pulling on one cord end while the other cord end is fixed in place.

Another object of the present invention is to allow complete concealment of the cord ends within the device for protection of the cord from dirt and dust by providing a generally flexible outer wall for protection of the cord from dirt and dust.

Still another object of the present invention is to provide a cord storage device which allows a user to install a cord into the device without disassembly of the cord storage device by providing a generally flexible outer wall allowing user access to the device interior.

It also is a principle object of the present invention to provide a cord reel and storage device which eliminates the use of internal rotating cord spools and rotating housing pieces and the associated bearings required in prior art cord reels and which avoids the need of a handle or crank for rewinding of the cord within the device.

Another object of the invention is to provide a cord reel and storage device which is low in cost by avoiding the high tooling costs associated with intricate and precision molded parts and with moving parts and the manufacture of various bearing surfaces required in prior art devices having internal moving spools and rotating housings.

Yet another object of the invention is to provide a cord reel and storage device which eliminates the high friction situations between rotating parts of prior art devices.

Still another object of the invention is to provide a cord reel and storage device which applies a clamping action against the cord to prevent the cord from loosening on the reel and falling in loose coils off of the reel and to prevent the wound cord from tangling on the reel.

These objectives and other benefits are achieved by a cord reel and storage device comprising a generally annular-shaped container having a hollow interior and presenting an inner wall and a flexible outer wall having a continuous circumferential opening in the outer wall of said container to provide access to said container interior and to allow user insertion of the cord upon flexing said outer wall to access said interior and a divider within said interior extending generally from said inner wall and terminating proximate to said circumferential opening for partitioning said interior into a first container half and a second container half, and a void in said divider to permit cord communication between said first and second halves for windable cord storage about said container inner wall of a first cord-portion in said first half and for windable storage about said container inner wall of a second cord-portion in said second half to accomplish separated cord-portion storage to allow both independent as well as simultaneous winding and unwinding of said first and second cord-portions.

Among the man advantages of the present invention is the advantage of winding the cord, hose, or wire or other line-type of material into the storage areas 13, 15 in the same direction on both sides or in opposite directions. When the cord-portions are wound oppositely the cord cannot be unwound from the device by a user pulling simultaneously on both cord ends. This, in effect, locks the cord in places and no more cord can be released from the device without the user intentionally unwinding cord from one side or the other.

In operation, a user unwinds a desired or selected amount X of cord from device by separately unwinding cord from one or both storage areas 13, 15. (FIG. 1*a*). This provides the user with a specific amount of unwound cord which cannot be changed by a child or small animal pulling on the cord or the device. In this method of use the user can reposition the location of the device along the selected cord length by simply holding one cord end and pushing the device away from the held end and toward an alternate location. As the cord holder device travels along the cord length some cord is wound-onto one side of the device and an equal amount of cord is wound-off the opposite side of the device, but the amount of exposed cord remains constant and in this manner the device can be repositioned anywhere along the cord length while maintaining the same length of user selected cord.

In the present application, various alternative embodiments are provided in which the cord communication is accomplished by routing the cord through a central channel that spans the interior void of the donut shaped shell and/or by routing the cord through the embodiments of the divider to direct the cord into each container-half. In these embodiments, the foregoing objectives and other benefits are achieved by a cord reel and storage device comprising a generally annular-shaped container having a hollow interior and presenting an inner wall and a flexible outer wall, having a continuous circumferential opening in the outer wall of said container to provide access to said container interior and to allow user insertion of the cord upon flexing said outer wall to access said interior and a divider within said interior extending generally from said inner wall and terminating proximate to said circumferential opening for partitioning said interior into a first container half and a second container half, and a void in said divider permitting passage of the cord between said first and second halves for windable storage about said container inner wall of a first cord-portion within said first half and for windable storage about said container inner wall of a second cord-portion within said second half to accomplish separated cord-portion storage to allow both independent as well as simultaneous winding and unwinding of said first and second cord-portions.

Generally, prior art devices do not permit the user to enclose the cord ends and instead leave the ends exposed. This can allow the cord ends to be caught on passing objects and can allow the cord to be unwound and defeat the purpose of the storage device. In addition, the ability of the present invention to allow concealment of the cord ends prevents small children from unwinding the cord and creating a potentially dangerous situation. The present invention permits full concealment of the cord ends within the storage area, and allows for complete closure of the cord storage device. In this mode of use dust and dirt and moisture can be excluded from the interior of the storage device.

The foregoing and other objects are not meant in a limiting sense and will be readily evident upon a study of the following specification and accompanying drawings comprising a part thereof. Other objects and advantages of this invention will become apparent from the following description taken in connection with the accompanying drawings, wherein is set forth, by way of illustration and example, an embodiment of this invention.

BRIEF DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

FIG. 12 is a cross section view of another embodiment of the cord holder device taken along line B-B of FIG. 14 and showing top half 50 and bottom half 52 and showing deflection veins 62*a* and 62*b* which are contained within central channel 64 (FIG. 13) and which operate to deflect a cord from bottom half 52 into top half 50 when the cord is inserted into central channel 64;

FIG. 13 is a cross section view of the embodiment of FIG. 12 taken along line A-A of FIG. 14;

FIG. 14 is a top plan view of the embodiment of FIG. 12;

FIG. 15 is a side elevation view the embodiment of FIG. 12 looking along the longitudinal axis of the central channel 64;

FIG. 16 is a side elevation view the embodiment of FIG. 12 perpendicular to the longitudinal axis of central channel 64;

FIG. 29 is a side view of the divider of the embodiment of FIG. 21 and showing molded deflection channel 68*a* and 68*b;*

FIG. 30 is a front elevation view of the divider of the embodiment of FIG. 21 and viewing molded deflection channels 68*a* and 68*b* in a front view;

FIG. 31 is a plan view of the divider of the embodiment of FIG. 21 and showing molded deflection channel 69*a* protruding out of paper and 68*b* extending down into plane of the paper;

FIG. 34 is a cross section view of yet another embodiment of a cord holder showing cord 17 entering bottom half 52 passing through divider 54 through central opening 58 into top half 50 and exiting the other side;

FIG. 35 is a side view of the divider of the embodiment of FIG. 34;

FIG. 36 is a top plan view of the divider of the embodiment of FIG. 34 and showing in phantom lines relative position of hub 60*a*, 60*b* with respect to the divider;

DETAILED DESCRIPTION OF THE PREFERRED EMBODIMENTS

Figure 1A:
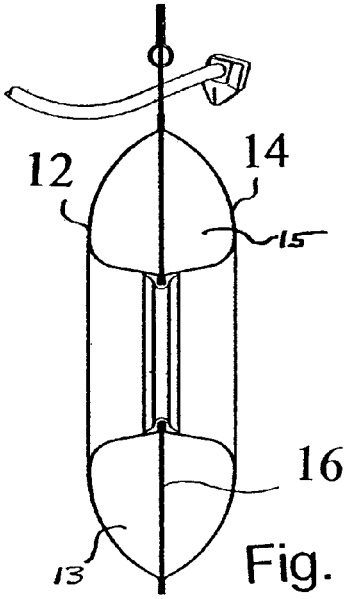
FIG. 1*a* is a cross-section view of a first embodiment of the invention taken along section A-A of FIG. 1B and showing an extension cord inserted through the opening in the handle of the divider.
Figure 1B:
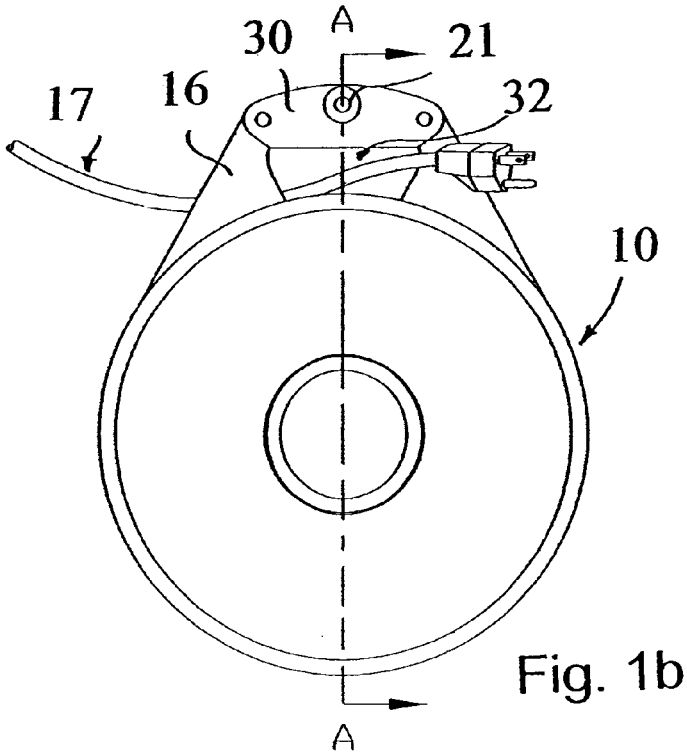
FIG. 1*b* is an elevation view of the cord holder device of FIG. 1*a* showing an extension cord inserted through the opening in the handle of the divider.

Referring now to FIG. 1*a*, the present invention is shown in a cross section view taken along line A-A of FIG. 1*b*. In FIG. 1A, the two shell halves 12, 14 of the device are shown being separated by divider 16 which passes through the center of the annulus shape of device 10 (FIG. 1*b*) thereby bilaterally dividing device 10 into shell halves 12 and 14. As best viewed in FIG. 1*b*, divider 16 is provided with a handle 30 which is integral with divider 16 and which extends outwardly from shell halves 12, 14 of device 10. Handle 30 creates a convenient means of grasping device 10 by the user. Handle 30 is further provided with an aperture 21 which allows device 10 to be hung from a hook. In general, the device operates as described in U.S. Pat. No. 5,992,787; however, the present improvement to the invention described in U.S. Pat. No. 5,992,787 allows a cord 17 (FIG. 1*b*) to be easily inserted into and engaged with divider 16 to present approximately half of cord 17 on one side of divider 16, and the other half of cord 17 on the other side of divider 16 thereby permitting half of the cord to be loaded into shell half 12, and the other half of the cord to be loaded shell half 14.

Figure 2A:
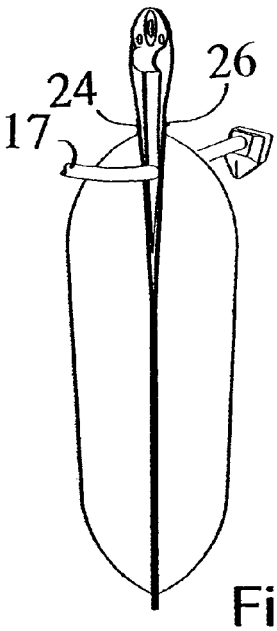
FIG. 2*a* is a side elevation view of the cord holder device FIG. 1*a* showing the extension cord after insertion through the handle opening in the divider and showing the cord urged partially downwardly towards the center of the cord holder device.
Figure 2B:
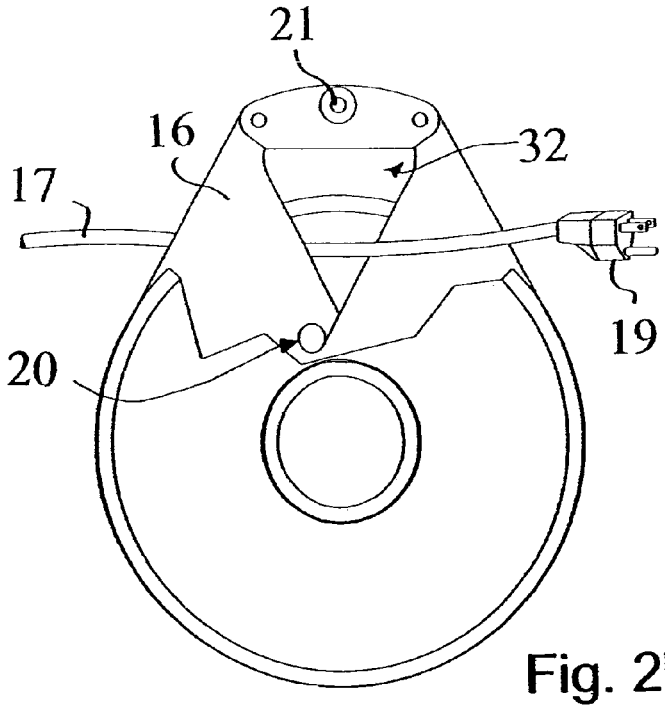
FIG. 2*b* is a fragmentary, front elevation view of FIG. 2*a* showing the extension cord after insertion through the handle opening in the divider and showing a portion of the shell half removed to reveal the cord moved partially downwardly towards the center of the cord holder device.

The loading of cord 17 into divider 16 will now be described with reference to FIGS. 1-5. With reference to FIGS. 1*a*, 1*b*, cord 17 is shown being passed through an opening 32 below handle 30 on divider 16. Opening 32 can be of any reasonable size which serves to allow cord 17 to pass there through. It is also beneficial if opening 32 is sufficiently large to allow the fingers of the hand to pass through opening 32 to allow handle 30 to operate more conveniently. As shown in FIGS. 2*a*, 2*b*, once cord 17 has been passed through opening 32, a sufficient amount of cord 17 is drawn through opening 32 to permit the user to grasp cord 17 on either side of device 10 and to allow the user a sufficient grip to gently urge cord 17 downwardly in opening 32 and toward pass-through void 20 (FIG. 2*b*) in divider 16.

Figure 3A:
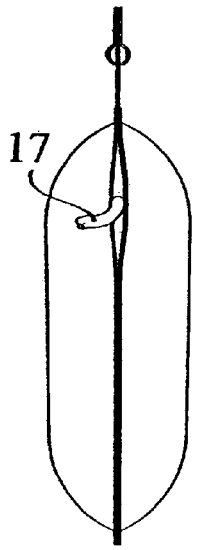
FIG. 3*a* is a side elevation view of the embodiment of FIG. 1*a* showing the cord inserted through the opening in the handle of the cord holder device and with the cord further urged or pressed downwardly to abut the flap or slit included at the base of the handle opening of the divider.
Figure 3B:
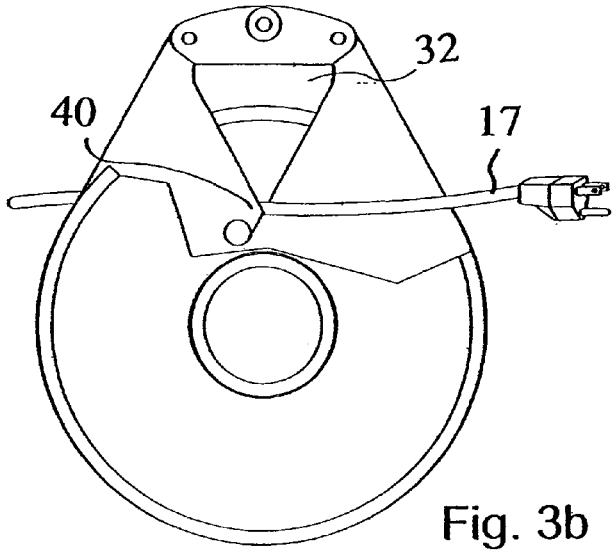
FIG. 3*b* is a fragmentary, front elevation view of the embodiment of FIG. 1*a* with a portion of the front half of the divider removed to reveal the upper half of the divider with the cord pressed downwardly to abut the slit or flap included at the base of the handle opening of the divider.

As is shown in FIGS. 3*a*, 3*b*, as cord 17 is urged or pressed downwardly within opening 32, cord 17 contacts divider flap 40*a,b*. Flap 40*a* contains pass-through void 20 and flap 40*b* which is proximate to pass-through void 20 may either overlap flap 40*a* or abut the edge of flap 40*a*. The presence of divider flap 40 creates a flexible flap adjacent to pass-through void 20 which is deflected by the downward pressure caused by the urging of cord 17 downwardly in opening 32 and allows divider flap 40 to be deflected toward either side of device 10, that is either toward shell half 12 or toward shell half 14 to present an opening which allows cord 17 to slide into pass-through void 20 and allows cord 17 to then reside within pass-through void 20 as is shown in FIG. 4*b*. Divider flap 40.

Figure 4A:
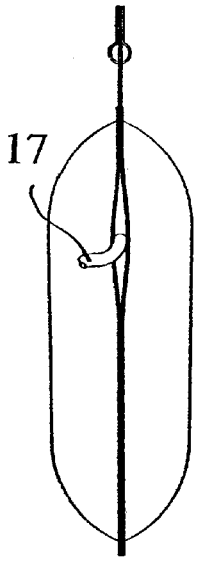
FIG. 4*a* is a side elevation view of the embodiment of FIG. 1*a* with the cord extending outwardly from the two halves of the donut-shaped shell of the device.
Figure 4B:
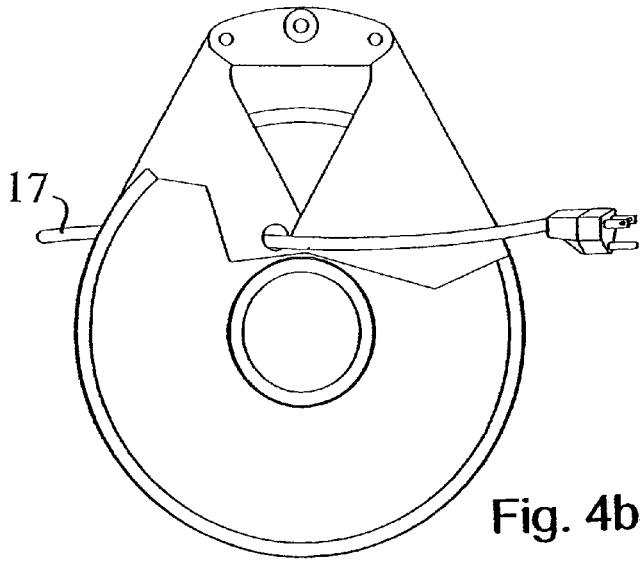
FIG. 4*b* is a fragmentary front elevation view of the embodiment of FIG. 1*a* with a portion of the front donut-shaped shell removed to reveal the divider separating the two halves of the cord storage device and showing the extension cord that has been pressed downwardly past the slit or flap at the base of the handle opening of the divider and which slit or flap is deflected outwardly by the pressure of the downwardly urged cord to allow the cord to pass along the slit and to become positioned within the pass-through void of the divider.
Figure 5:
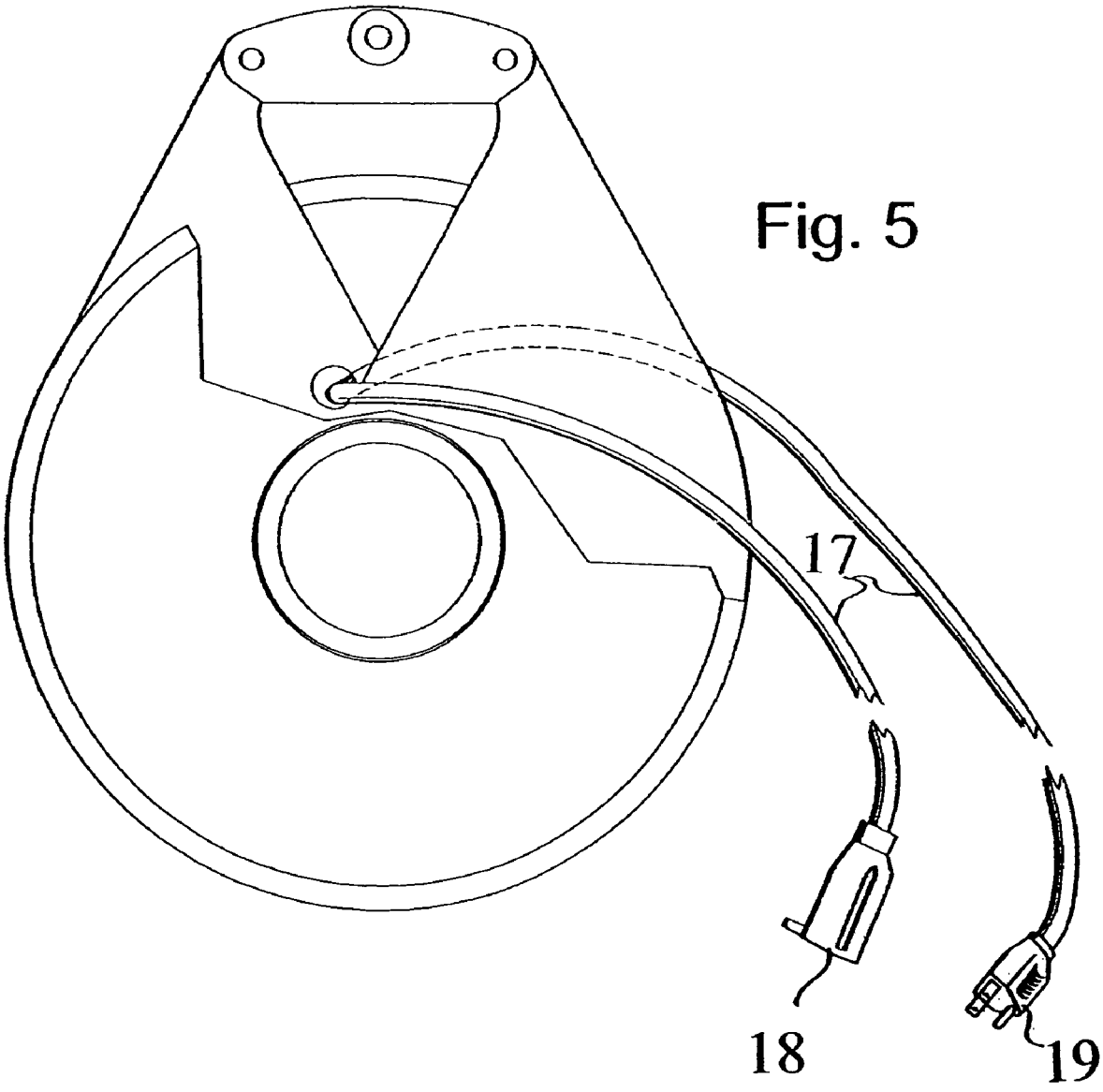
FIG. 5 is a fragmentary, front elevation view of the embodiment of FIG. 1*a* having a portion of the front donut-shaped shell removed to reveal the divider that separates the two halves of the cord storage device shows the extension cord positioned in the pass-through void of the divider with approximately half of the cord on one side of the divider and one half of the extension cord on the opposite side of the divider.

In FIG. 4*a*, cord 17 is shown more downwardly positioned than is shown in FIG. 3*a*. The position of cord 17 in FIG. 4*a* corresponds to the position of cord 17 in FIG. 4*b* where cord 17 is shown residing in pass-through void 20. Once cord 17 is positioned in pass-through void 20 as heretofore described, cord ends 18, 19 of cord 17 can be drawn to the same side of device 17 as is shown in FIG. 5, or the ends of cord 17 can be drawn to opposite sides of device 10 as is shown in FIG. 4*b*. If cord ends 18, 19 of cord 17 were to be wound in the same direction around device 10, cord ends 18, 19 would be drawn to the same side of device 10 as is shown in FIG. 5. Alternatively, if cord ends 18, 19 were to be wound in opposite direction around device 10, the cord ends would be arranged on opposite sides of device 10 as is shown in FIG. 4*b*.

The benefits of this new divider 16 provided with divider flap 40 which allows access to pass-through void 20 are quicker and easier loading of cord 17 within the device, and quicker and easier removal of cord 17 from the device. This ease of operation being assisted by the large opening 32 in divider 16 which both provides for handle 30 and allows cord 17 to be easily passed through a large opening in divider 16.

Figure 6:
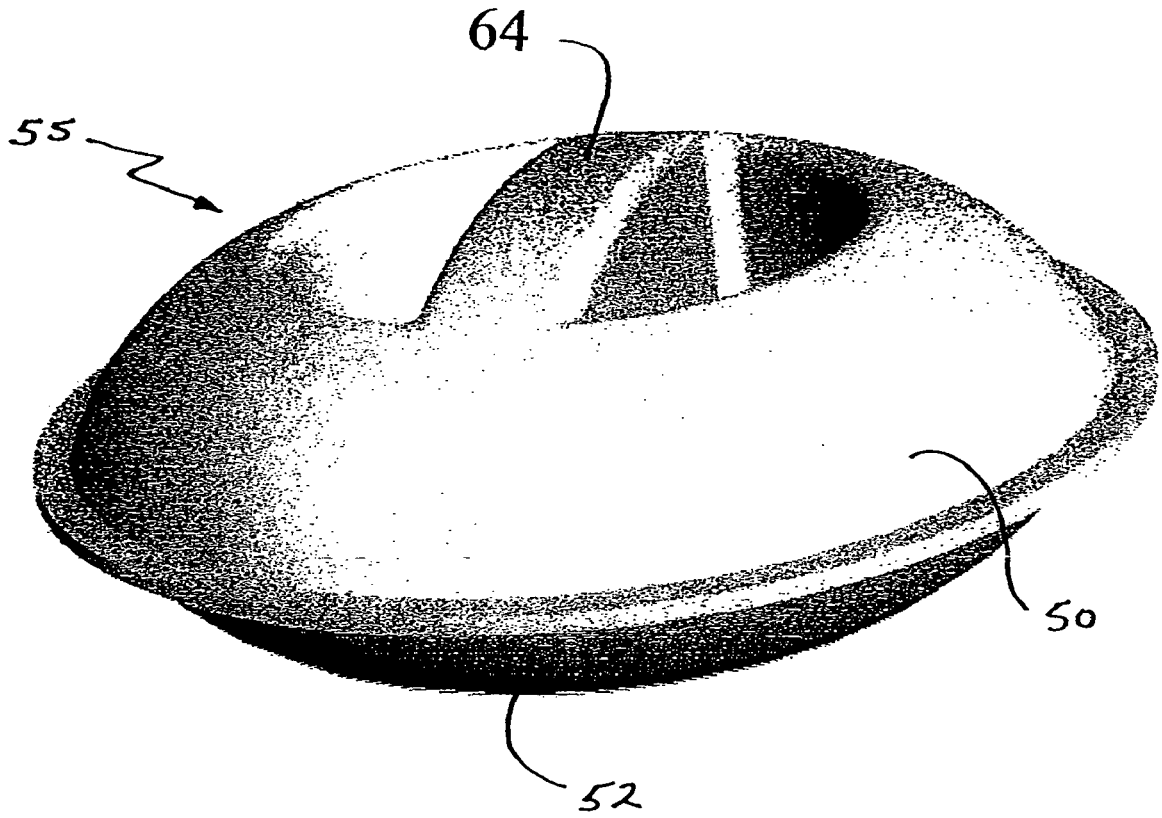
FIG. 6 is a top-front perspective view of a second embodiment of the cord holder showing the central channel 64.
Figure 7:
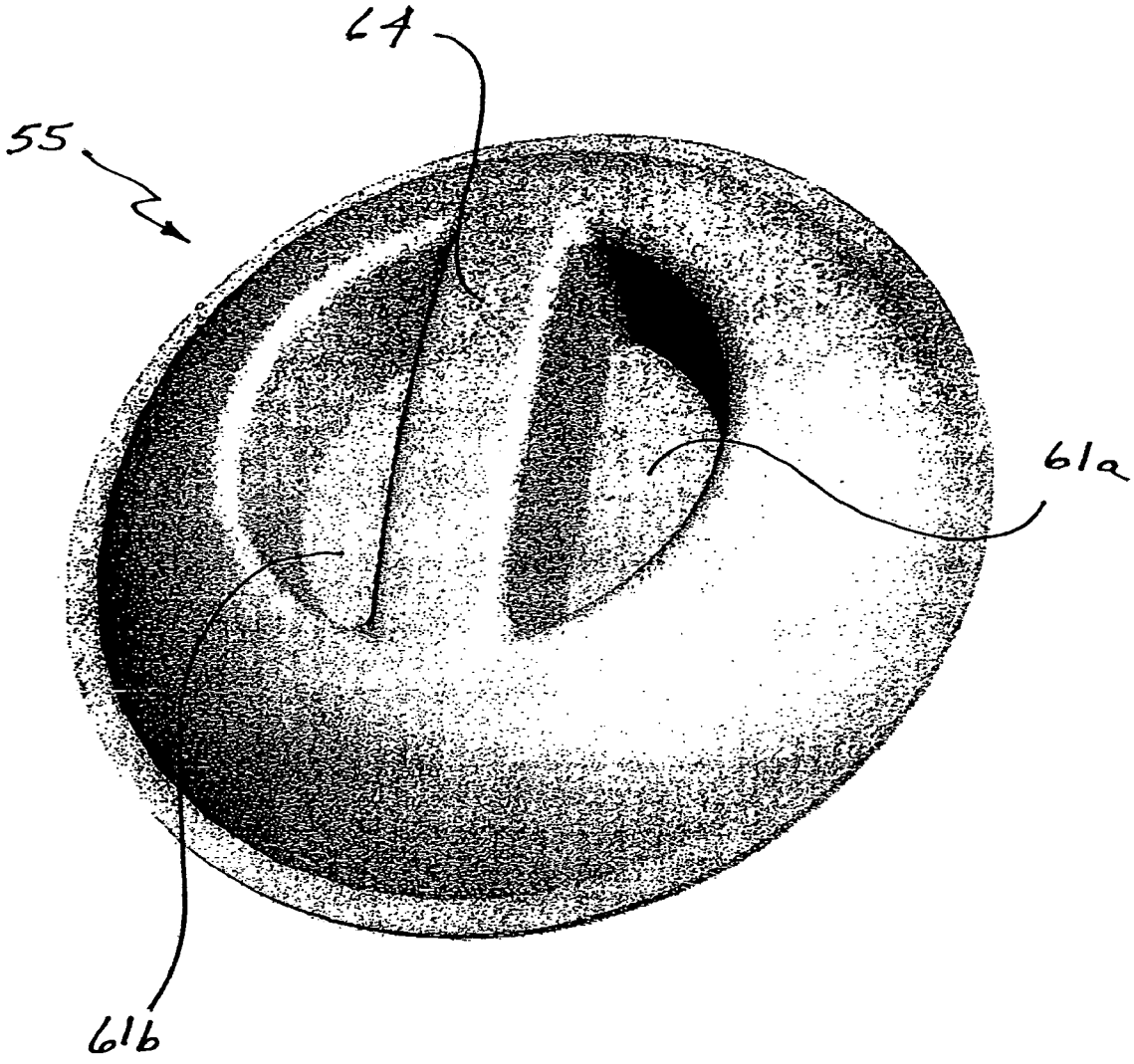
FIG. 7 is a top-perspective view of the cord holder of FIG. 6 showing the hub halves 6*a*, 6*b* at either side of central channel 64.

Now referring to FIGS. 6 and 7, a top perspective view of an embodiment of cord reel and storage device 55 is shown. Device 55 is an annular ring comprised of two joined shell-halves 50, 52 which form a hollow annular ring or donut-shaped container which has a central channel 64 spanning the diameter of device 55 into which cord 17 is loaded. Halves 50, 52 are joined at hub halves 60*a, b* and 61*a, b* (FIGS. 9 and 10) which are located on either side of central channel 64. It will be appreciated by those skilled in the art that 61*a,b* and 60*a,b* could be open voids without the operation of the device being affected. In such an embodiment the interior walls of the shell halves contain the cord and the shell halves can be connected together where the interior walls of the shell halves meet one another.

Figure 8:
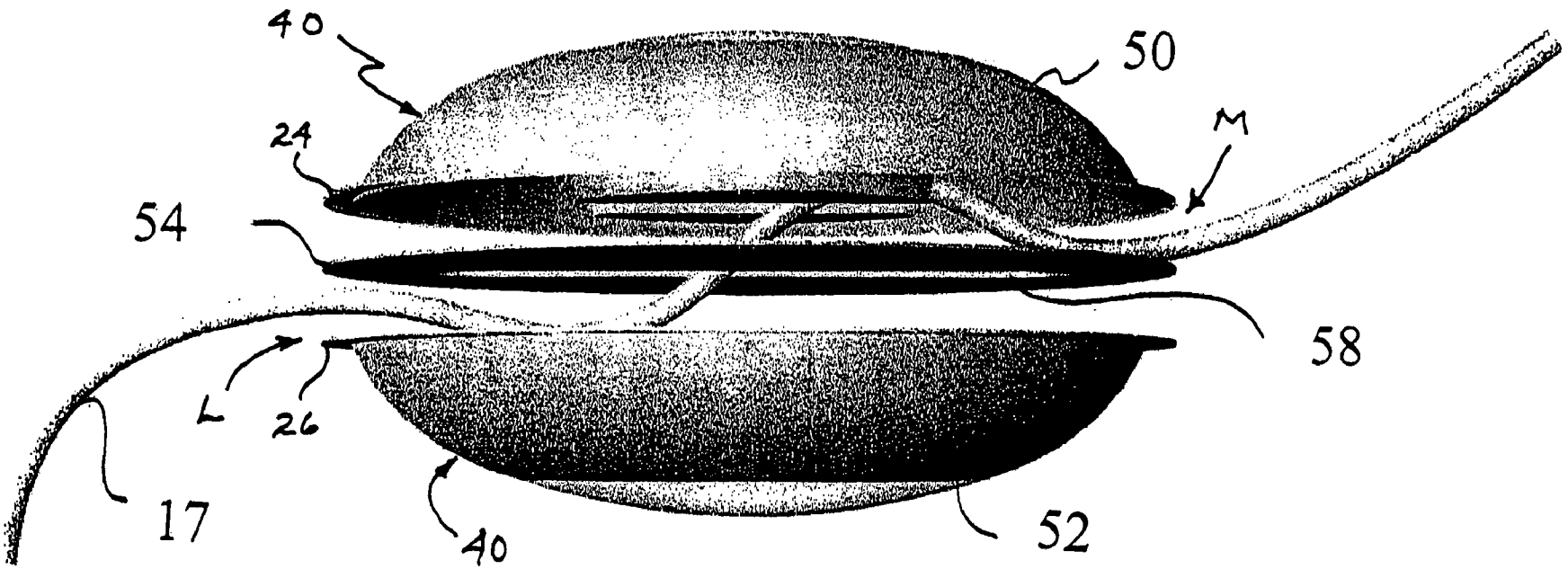
FIG. 8 is a side exploded view of the device of FIGS. 6 and 7 showing the top half 50 and bottom half 52 of outer shell and showing the divider 54 in between and showing cord 17 passing through central opening 58 of divider 54 to position a portion of cord 17 in top half 50 and a portion of cord 17 in bottom half 52.

Referring now to FIG. 8, cord 17 communicates through divider 54 to provide a portion of cord 17 on either side of divider 54. Cord 17 extends outside of device 55 from a first or front side of divider 54 (Arrow L) and cord 17 extends outside of device 55 from a second or back side of divider 54 (Arrow M).

Shell-halves 50, 52, as a joined whole, may be described in practical terms as comprising, generally, a donut-shape with the interior of the donut being hollow to provide a space for holding a cord—in other words the general shape of device 55 is a hollow annulus, or hollow annular ring, or donut shape having a hollow interior space separated by divider 54 into two cord storage portions. Shell-halves 50, 52 can be formed from any material providing sufficient flexibility to permit outer wall 40 of halves 50, 52 and flanges 24, 26 to be flexed away from divider 54 to permit cord passage from the interior storage areas 13, 15 (FIG. 1*a*) to the outside of device 55.

It is also important and useful for shell-halves 50, 52 to have a flexible outer wall 40 which is sufficiently flexible to allow a user to open outer wall 40 and flanges 24, 26 to allow insertion of a user provided cord 17 through pass-through opening 58 of divider 54. In this manner, a user can replace a worn cord or can substitute any cord into device 55 without the need to dismantle device 55 as is the case and problem in prior art devices.

Figure 9:
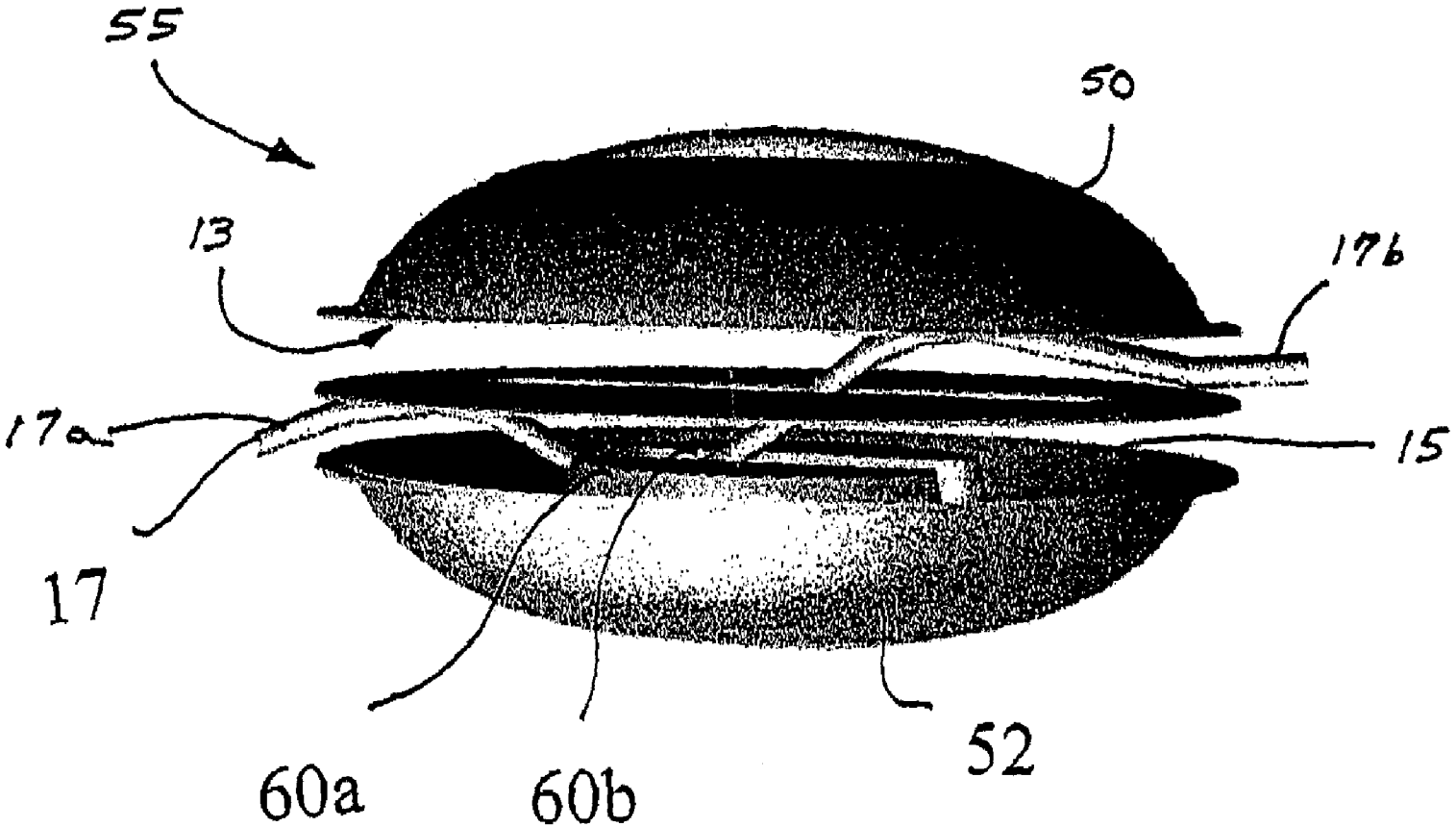
FIG. 9 is an exploded view of the device shown in FIG. 8, but from a higher position and showing the position of cord 17 in bottom half 52 with cord 17 passing between hub half 60*a* and hub half 60*b* to allow entry of cord 17 into central opening 58.

FIG. 9 is an exploded view of the embodiment of FIG. 8. As stated above, cord 17 extends outside of device 55 from a first or front side of divider 54 extends out from a second or back side of divider 54. This separation of cord 17 into cord portions 17*a* and 17*b* is achieved by pass-through opening 58 (FIG. 10) in divider 54 which allows cord 17 to communicate from half 52 to half 50 and permits cord-portion 17*a* to be located within hollow space 15 of half 52 for storage therein and another portion of cord 17, cord-portion 17*b*, to be located within hollow space 13 of half 50 for storage. It will be appreciated that cord storage areas 13, 15 within halves 50, 52 are maintained as generally separate compartments by divider 54. Pass-through opening 58 (FIG. 10) is sufficiently large to permit passage of either of cord ends of cord 17 therethrough to allow cord 17 to be divided among storage areas 13, 15 of halves 50, 52 of the donut-shaped device 55.

Still referring to FIGS. 8 and 9, to load a cord 17 into device 55, a user flexes the outer wall 40 of shell 50 at either end of the central channel 64 away from divider 54 to allow access to storage area 13. User then flexes the outer wall 40 of shell 52 at the other end of the central channel 64. Cord 17 is inserted and pulled through opening 58 until approximately half of the length of cord 17 is on either side of divider 54 (See, FIG. 37). To distribute a portion of cord 17 to either side of opening 58, cord portions 17*a*, 17*b* can be simultaneously (See, FIG. 38) or individually wound into storage-halves 13, 15 of shell-halves 50, 52. While winding cord 17 into device 55, opening 58 serves to anchor cord 17 within device 55 so that cord 17 does not slide around the interior of device 55. Once cord 17 is wound into device 55 it is contained within storage areas or storage-halves 13, 15. (See, FIG. 39).

It will be appreciated by those skilled in the art that divider 54 serves to maintain cord portions 17*a*, 17*b* in separated fashion within storage areas 13, 15. In this manner each cord-half 17*a*, 17*b* can be individually wound and unwound while avoiding becoming tangled with the other cord-half. Such tangling of cord halves is a significant and constant problem with reel-type storage devices which merely anchor the midpoint of the cord to the reel for winding of both cord ends thereon. In such devices the two cord halves do not wind and unwind evenly, and during use one cord half frequently becomes inter-twined with the other cord half. During the next unwinding from the holder, the user must cease unwinding and untangle the two cord halves. This problem is eliminated in the present invention while also eliminating the need for moving parts and bearing surfaces and precision manufacturing of parts required in prior art devices. The divider 54 and separate storage compartments 13, 15 of the present invention cause the cord-portions to become untangled during rewinding and thereby condition the cord for the next use.

Referring now to FIG. 13, it can be observed that halves 50, 52 are each one-half of an annular ring or donut shape having a hollow interior. When half 50 is joined with half 52 the whole hollow annular ring is bilaterally bisected or separated by divider 54 to provide two hollow annular halves 50, 52 having an interior storage space 13, 15 in which each space 13, 15 is separated from the opposing half space 13, 15 of the annular ring by divider 54. The two ring halves 50, 52 are joined with hub half 60*a* connected to hub half 61*a* and hub half 60*b* connected to hub half 61*b* (FIG. 13). Hub halves 60*a,b* and 61*a,b* are located on either side of central channel 64. The manner of connecting halves 50, 52 is discussed hereinafter.

Figure 10:
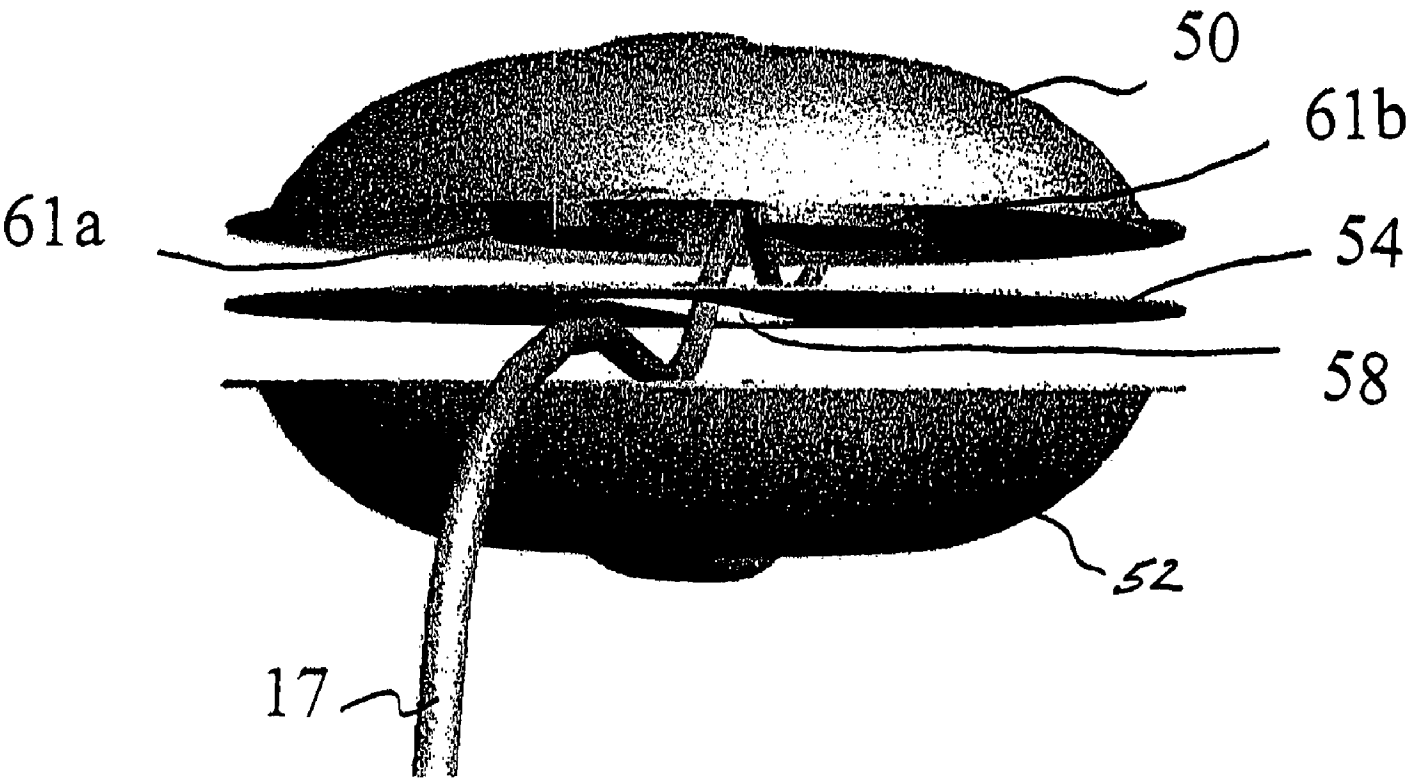
FIG. 10 is an exploded view of the device of FIG. 8 showing cord 17 passing through central opening 58 of divider 54 to position cord 17 between hub half 61*a* and 61*b* of top half 50.
Figure 11:
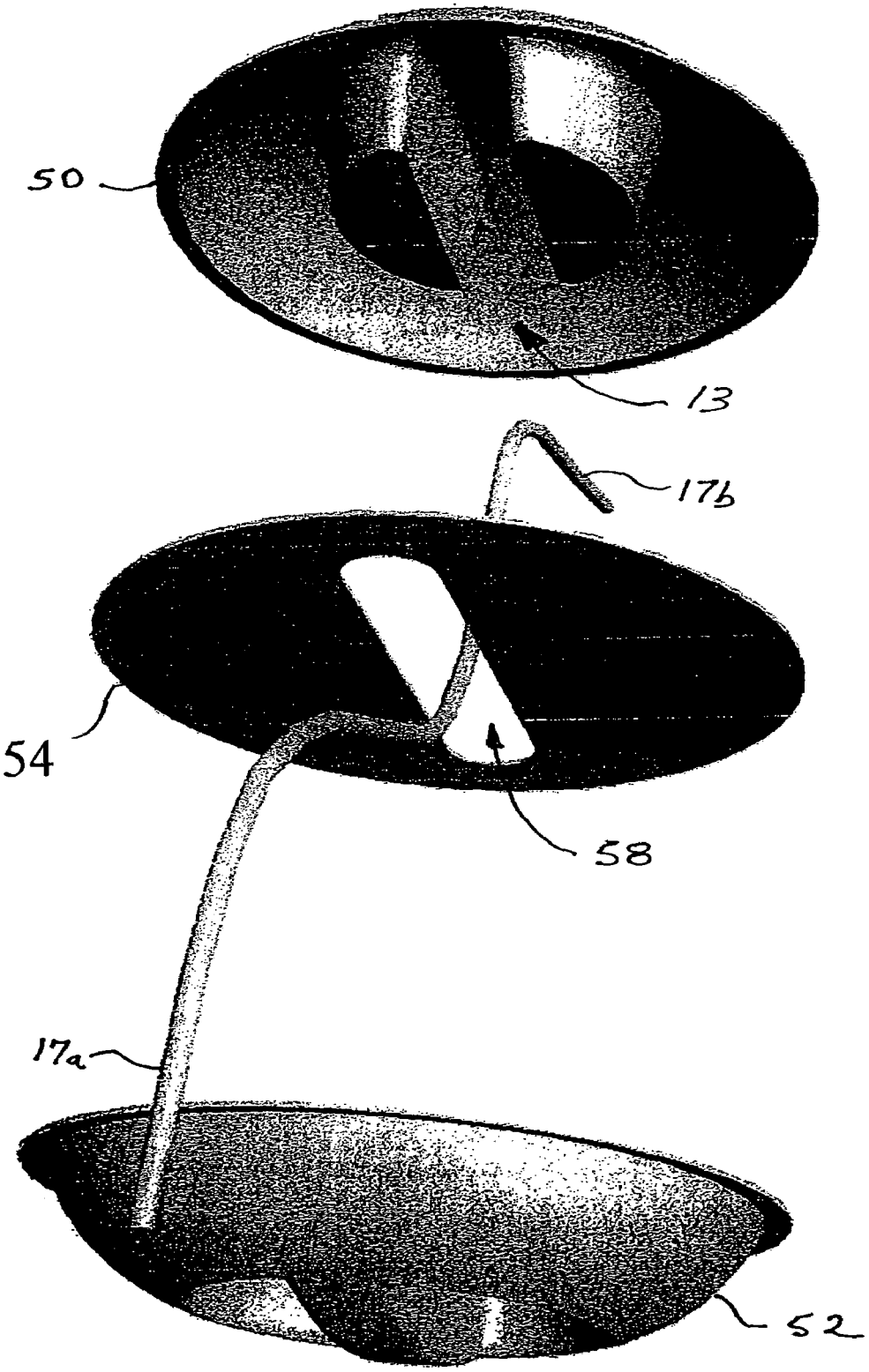
FIG. 11 is a widely exploded view of the device shown in FIGS. 6-10 showing the relationship of the cord and the divider and the central channel.

Divider 54 in FIGS. 9, 10 and 11 is shown with cord 17 inserted through opening 58 with approximately half of cord 17, or cord portions 17*a*, 17*b*, on either side of divider 54. The insertion of cord 17 through divider 54 may be performed prior to assembly of divider 54 with halves 50, 52 or cord 17 may be inserted through opening 58 after the assembly of divider 54 between halves 50, 52. As previously described, once half 50 is joined to half 52 with divider 54 in place, cord 17 can be passed through opening 58 and cord portions 17*a*, 17*b* then wound within storage space 13 of half 50 and storage space 15 of half 52.

The assembly of half 50 to half 52 in the embodiment of FIGS. 9, 10 and 11 is accomplished by aligning hub halves 60*a* and 61*a* and hub halves 60*b* and 61*b* and securing the hub halves together. Adhesives or sonic welding or fasteners may be used to join the halves. The joining of the halves provides a central hub upon which divider 54 is captured.

Figure 17:
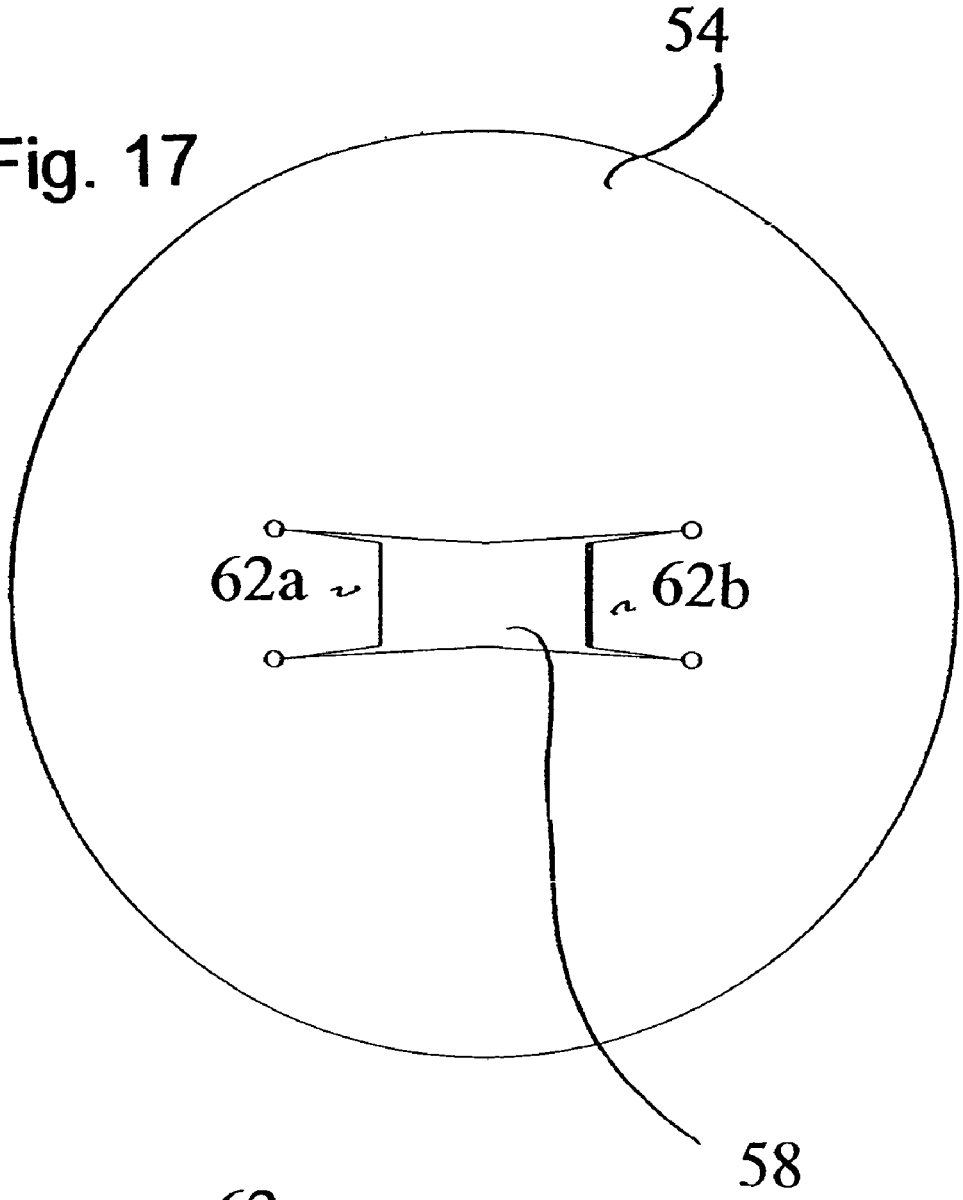
FIG. 17 is a plan view of the divider of the embodiment of FIG. 14 and showing deflection veins 62*a*, 62*b* with vein 62*a* directed into the plane of the paper and 62*b* extending upwardly from the plane of the paper.

Still referring to FIGS. 16 and 17, an alternative embodiment is shown in which cord 17 communicates between storage areas 13, 15 by extending outside of shell-half 50 through an aperture 52 in shell-half 50 and extending across junction 23 and into shell-half 52 through aperture 54 therein. In this embodiment pass-through opening 58 of divider 54 can be eliminated. Apertures 52, 54 in shell-halves 50, 52 can be made sufficiently large to allow cord ends 17*a*, 17*b* to be passed through apertures 52, 54.

Figure 18:
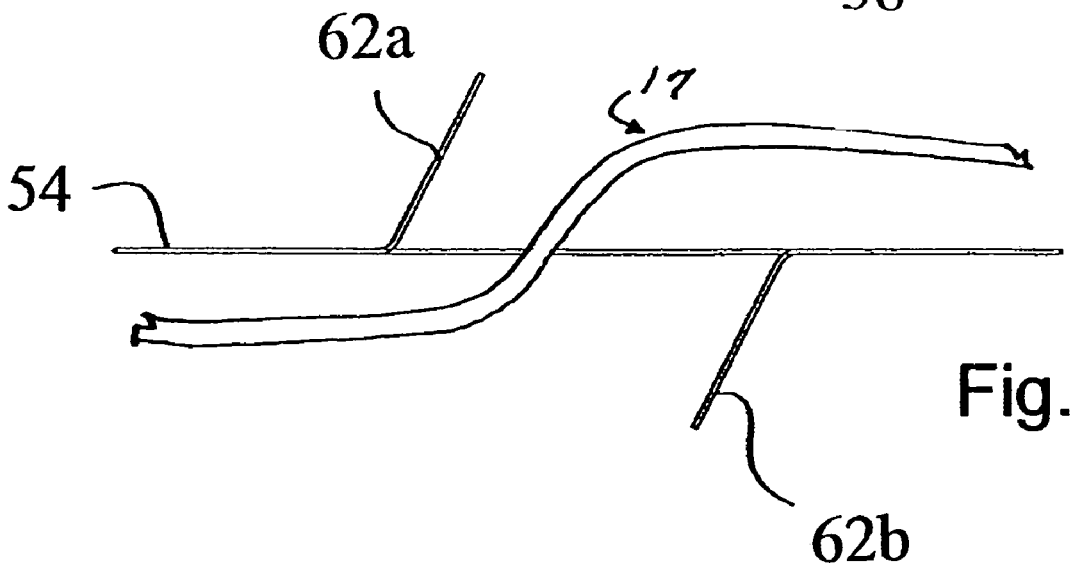
FIG. 18 is a side view of divider 54 of FIG. 21 and showing veins 62*a* and 62*b* shown bent outwardly from the plane of divider 54.

Referring now to FIG. 12, an alternate embodiment of the divider 54 which may be used with the embodiment shown in FIGS. 6-11 is shown. Divider 54 of the embodiment shown in FIG. 12 is comprised of a flat disc of material (FIG. 17) into which two deflecting veins or flaps 62*a*, 62*b* have been cut so as to align flaps 62*a*, 62*b* with central channel 64 (FIG. 13). As shown in FIG. 18, deflecting veins 62*a*, 62*b* are pressed to opposite sides of divider 54. As may be seen in FIG. 12, flaps 62*a*, 62*b* extend upwardly into channel 64 and serve to direct a cord 17 being introduced into channel 64 either upwardly or downwardly from a first half of the cord holder device into the second half of the cord holder device.

Figure 19:
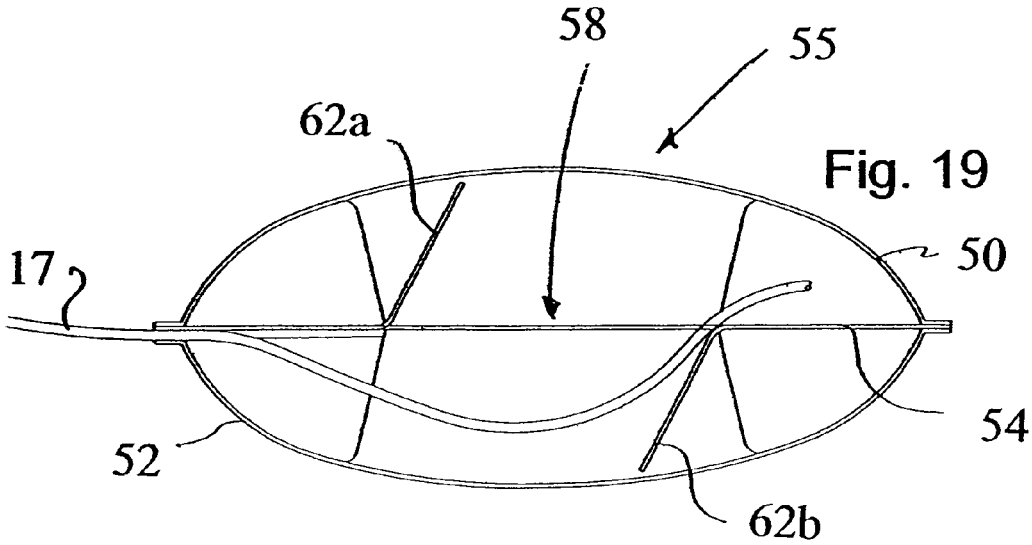
FIG. 19 is a cross section taken along line B-B of FIG. 14 showing cord 17 being introduced into the edge of the divider device 55 with the cord first entering into bottom half 62*a* and being deflected upwardly by deflecting vein 62*b* and through central opening 58 in divider 54 to direct cord into top half 50.
Figure 20:
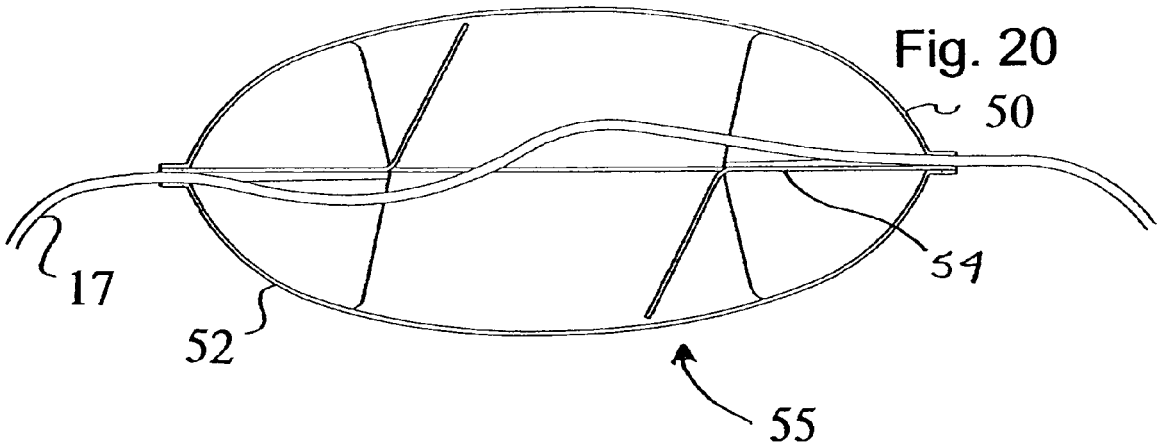
FIG. 20 is a cross section taken along line B-B of FIG. 14 showing cord 17 exiting the opposite side of device 55 after being positioned between top half 50 and divider 54 as shown in FIG. 19.

Referring now to FIGS. 19 and 20, the insertion of the cord 17 into device 55 having divider 54 of the embodiment shown FIG. 18 will be discussed. First referring to FIG. 19, a cord 17 has been introduced into shell half 52 where it is pushed along channel 64 (FIG. 14) until cord 17 is confronted by deflecting vein 62*b*. Deflecting vein 62*b* serves to prevent cord 17 from moving completely through central channel 64 and forces cord 17 upwardly and into the portion of central channel 64 which is formed by shell half 50.

Referring now to FIG. 20, once cord 17 has been deflected upwardly into shell half 50, a user can pull open or bend back shell half 50 from divider 54 and grasp cord 17 and pull it out the opposite side of device 55 from the side on which cord 17 entered device 55.

Figure 21:
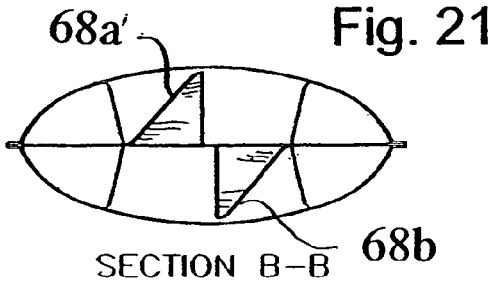
FIG. 21 is a cross-section view taken along line B-B of FIG. 23 and showing yet another embodiment of the cord holder and showing molded deflection channels 68*a* and 68*b* which are molded into position at the time of manufacture rather than bent into position as are deflection veins 62*a* and 62*b* on FIG. 18.
Figure 22:
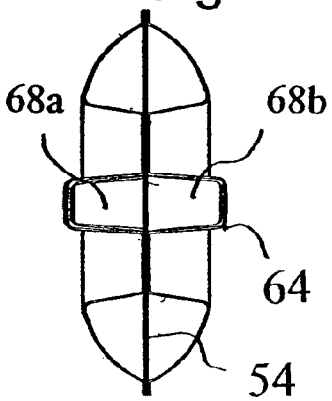
FIG. 22 is a cross section view taken along the line A-A of FIG. 23 and showing the position of molded deflection channels 68*a* and 68*b* within central channel 64.
Figure 23:
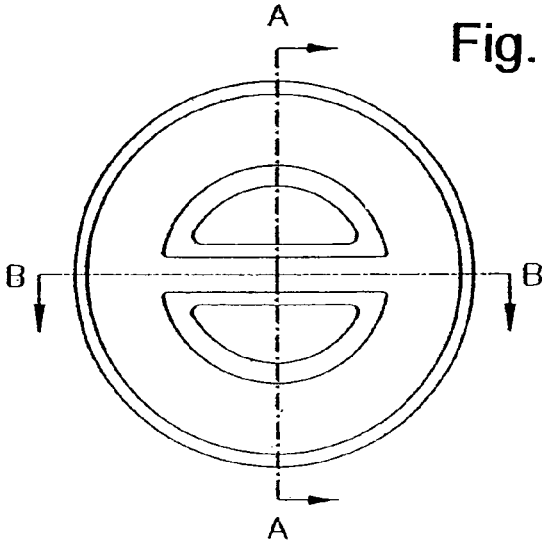
FIG. 23 is a top plan view of the embodiment of FIG. 21.
Figure 24:
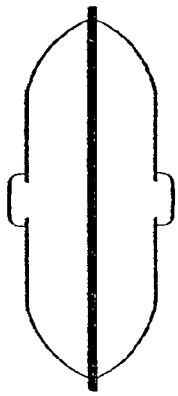
FIG. 24 is a side elevation view of the embodiment of FIG. 21 looking along the longitudinal axis of the central channel 64.
Figure 25:
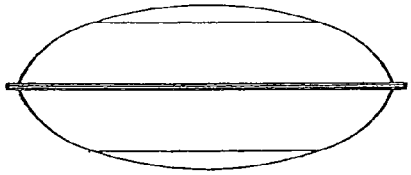
FIG. 25 is a side elevation view of the embodiment of FIG. 21 perpendicular to the longitudinal axis of central channel 64.
Figure 26:
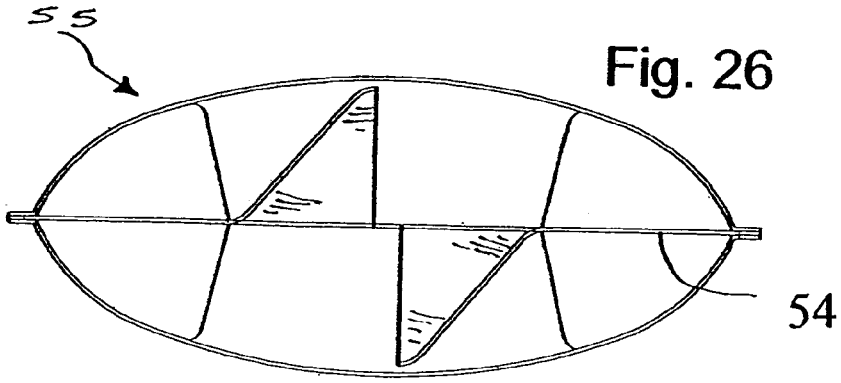
FIG. 26 is a cross section view of the embodiment of FIG. 21 taken along line B-B of FIG. 23.

Referring now to FIGS. 21-23, yet another embodiment of divider 54 is shown. The divider and embodiment of FIGS. 21-33 operates under essentially the same principle as the divider shown in FIGS. 12-20, however, the divider embodiment of FIGS. 21-33 presents deflecting structures 68*a*, 68*b* which are formed into divider 54 rather than being flaps which are pressed to either side of divider 54. The structure of divider 54 is most easily seen by observing FIGS. 29-31. In FIG. 31, it can be seen that divider 54 is a disc of material having deflecting veins 68*a*, 68*b* formed within the center of the disc. Deflecting veins 68*a*, 68*b* are positioned within disc or divider 54 so that they will align within central channel 64 of the cord holder device when divider 54 is assembled with shell halves 50, 52. The divider of the embodiment of FIGS. 21-33, as shown in FIG. 29, has a first deflecting channel or vein 68*a* projecting upwardly from divider 54 and a second deflecting channel or vein 68*b* projecting downwardly from divider 54. The insertion of a cord 17 into a device 55 having the divider embodiment shown in FIGS. 21-33 is best described by reference to FIGS. 26-28. In FIG. 26, a cross-section view of a device taken along line B-B of FIG. 23 is shown. In FIG. 26, no cord has been inserted into the device.

Figure 27:
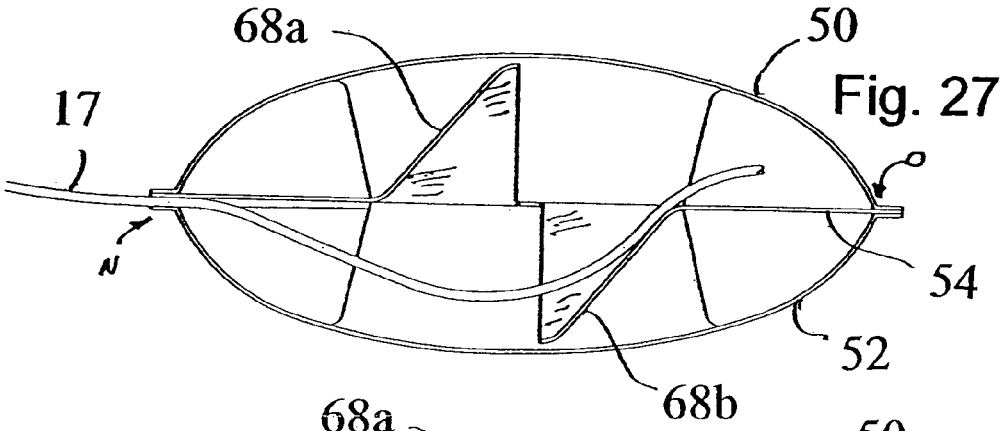
FIG. 27 is the embodiment of FIG. 26 and showing cord 17 being inserted into bottom half 52 and being deflected by molded deflection channel 68*b* into top half 50.
Figure 28:
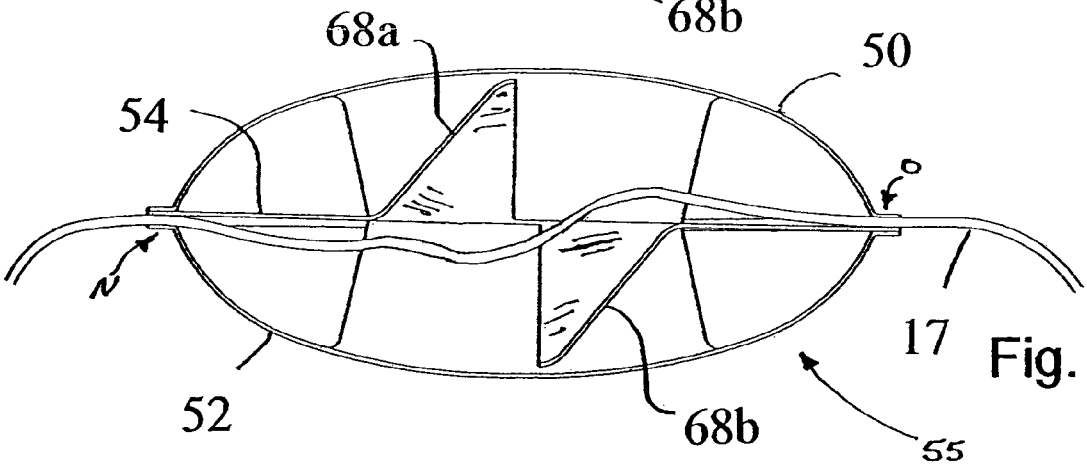
FIG. 28 is the embodiment of FIG. 26 and showing cord 17 passing into top half 50 being deflected by molded deflection channel 68*a* and bottom half 52 and out the other side.

Referring now to FIG. 27, a cord 17 has been introduced into shell half 52 of device 55 at point N and the cord has been pressed inwardly into central channel 64 of shell half 52 until the cord is deflected upwardly by deflecting vein or channel 68*b*. The deflection of cord 17 by deflecting vein or channel 68*b* presses the cord upwardly and into shell half 50. Referring now to FIG. 28, a user has pressed open device 55 at O and grasped cord 17 and pulled it to the outside of device 55. In this manner, approximately half of the cord may be positioned to reside within shell half 52, and the other half of the cord 17 may be positioned to reside within shell half 50 of device 55.

Figure 32:
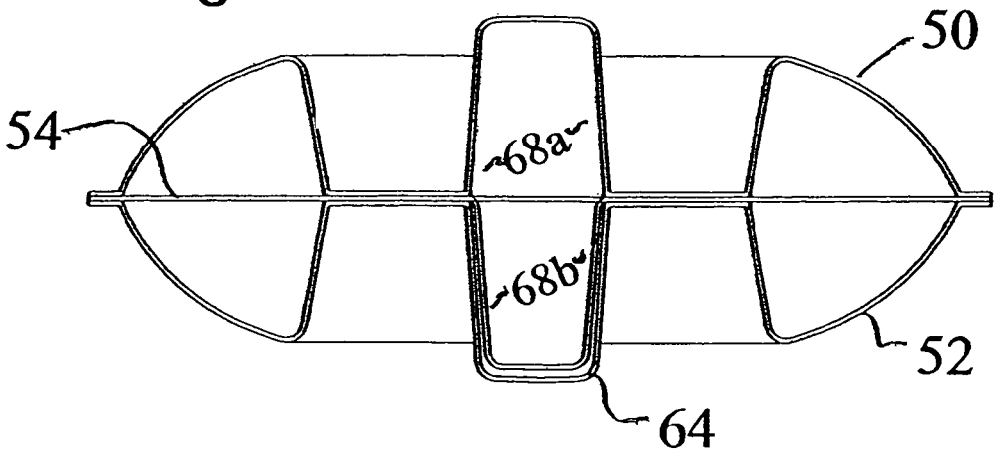
FIG. 32 is a cross section view of the embodiment of FIG. 21 taken along the line A-A of FIG. 23 and showing the position of molded deflection channels 68*a* and 68*b* within central channel 64 showing the assembled device.
Figure 33:
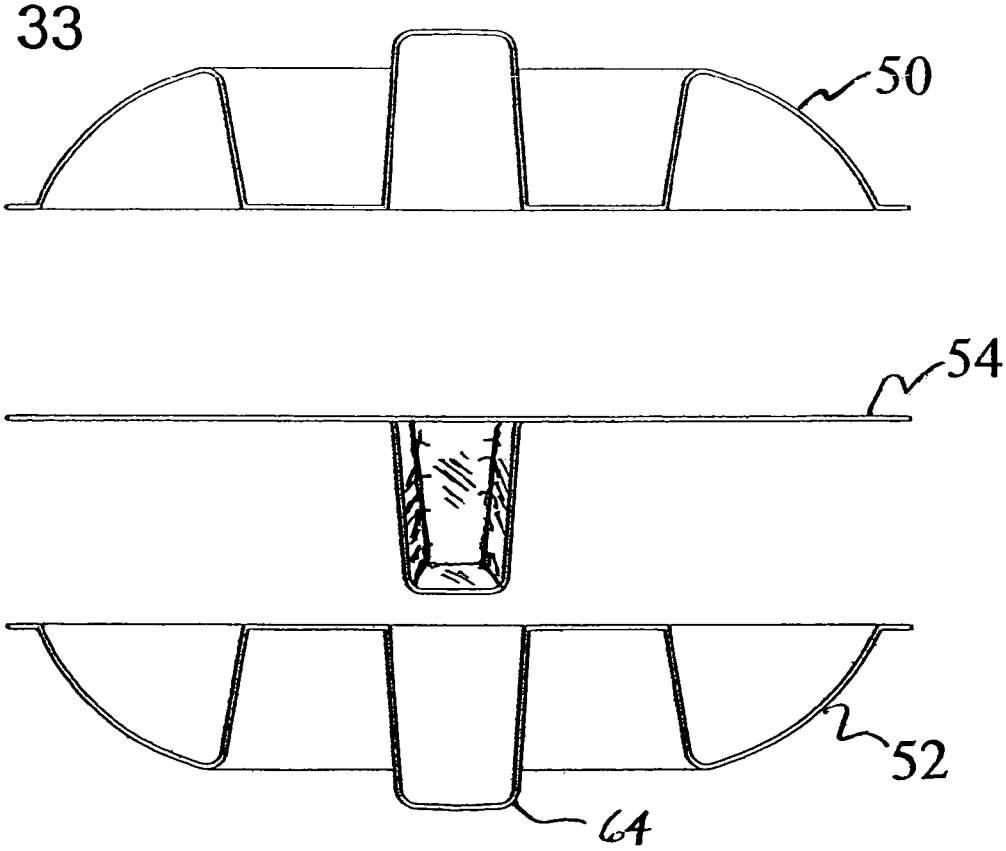
FIG. 33 is an exploded view of FIG. 32.

Referring now to FIG. 32, the positioning of deflection channel 68*b* is shown as it resides within central channel 64 of shell half 52. For clarity, an exploded view of FIG. 32 has been provided in FIG. 33 and indicating that divider 54 may simply be inserted to permit deflection channel 68*b* to be placed into central channel 64 whereupon shell half 50 may be brought to bear against shell half 52 and the two shell halves joined together as previously described.

Referring now to FIGS. 34-36, yet another embodiment of divider 54 will be described. The divider embodiment of FIG. 34-36 is essentially a disc having a circular void 58 cut into the center of the disc. Void 58 may be positioned so it resides over central channel 64 which is created by the presence of hub halves 60*a*, 60*b*. As shown in FIG. 35, this version of divider 54 is simply a generally flat sheet. In FIG. 34, the operation of the divider embodiment of FIGS. 34-36 is shown. In FIG. 34, a cord 17 is introduced into device 55 at the point indicated by arrow N. The cord 17 is fed into shell half 52 along central channel 64. A user may then reach into device 55 from the position indicated by Arrow O by pressing back the edge of shell half 50 to expose the interior of shell half 50 whereupon the user can reach in and grasp cord 17 and pull it out the opposite side of device 55 from the point of entry. It may be helpful for the user, once cord 17 has been introduced at point N to invert device 55 so that gravity causes cord 17 to fall through void 58 and divider 54 and into the opposite shell half 50 from shell half 52 where cord 17 was first introduced into the device.

Figure 39:
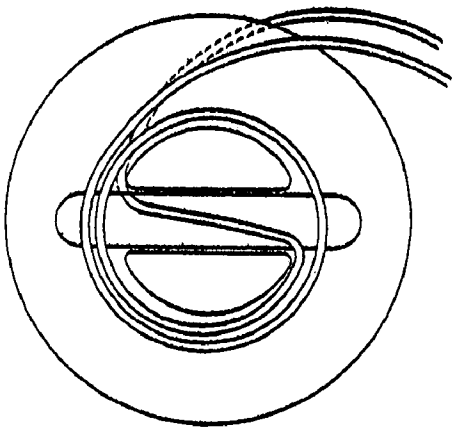
FIGS. 37-39 are cross-section views taken along line C-C of FIG. 8 and show a method of winding cord 17 with respect to divider 54 and central hubs 60*a* and 60*b;*
Figure 38:
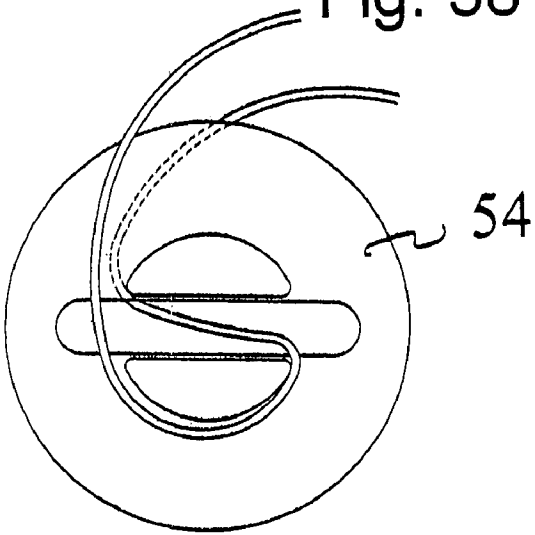
Figure 37:
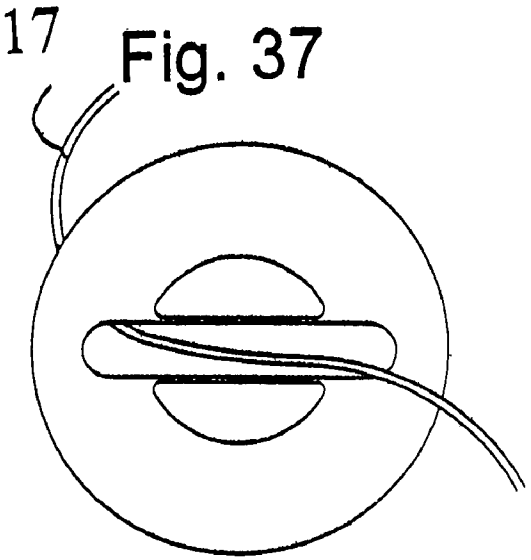

Referring now to FIGS. 37-39, the method of winding a cord 17 onto device 55 will be described. FIGS. 37-39 are a cross section taken along lines C-C of FIG. 8 and showing hub halves 60*a*, 60*b* in front of divider 54. Cord 17 has been inserted into shell half 50 which is behind divider 54, and cord 17 has been passed through the void 58 in divider 54 to communicate cord 17 from the cord storage area 13 of shell half 50 into the cord storage area 15 of shell half 52 (not shown). Cord 17 is now available to be wound about hub shell halves 60*a*, 60*b*. In FIG. 38, cord 17 is shown with both cord ends 17*a*, 17*b* prepared for winding in the same direction. Winding the cords in the same direction is most efficient from the standpoint of applying the cords to device 55 and allows both ends 17*a*, 17*b* of cord 17 to be wound and unwound simultaneously, and in particular, by grasping end 17*a* in one hand and end 17*b* in the other hand and pulling outwardly to release some of each cord end from device 55*b* simultaneously. The winding process is relatively simple, device 55 is held by the user in one hand, and cord end 17*a*, 17*b* are grasped in the other hand, and device 55 is rotated to wind cord 17*a*, 17*b* about hub halves 60*a*, 60*b* until the cord is wound about hubs 60*a*, 60*b* as shown in FIG. 39.

Figure 40:
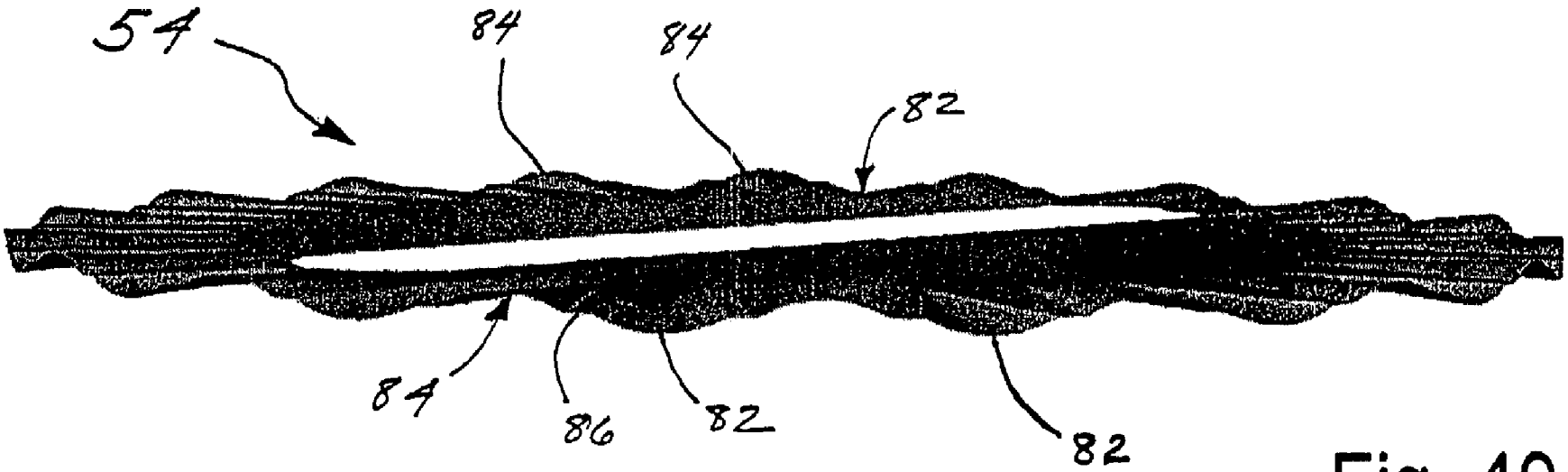
FIG. 40 is a perspective view of yet another embodiment of divider 54 having ridges and depressions for capturing a cord.
Figure 41:
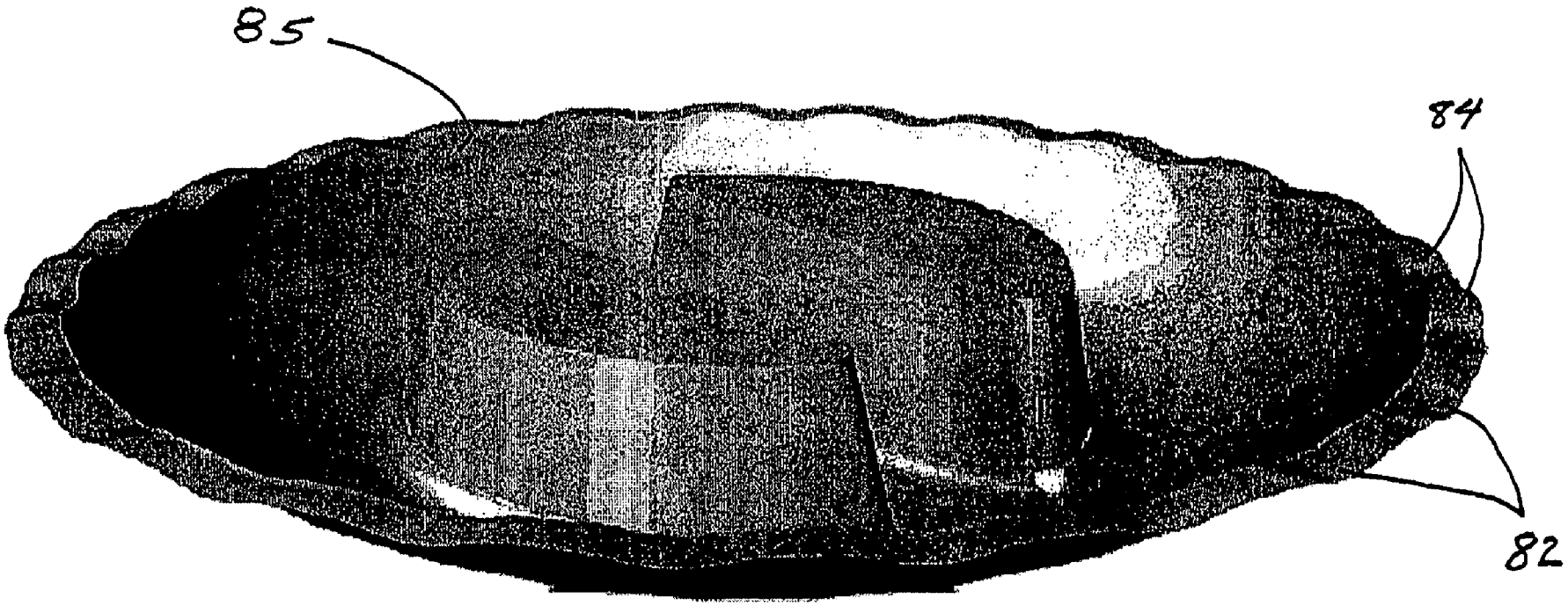
FIG. 41 is an alternate embodiment of a shell half 50, 52 having ridges and depressions on the lip of the shell to assist in capturing a cord in a particular position on the circumference of the device.

Referring now to FIG. 40, an alternate embodiment of divider 54 is shown in which the divider is provided with a "ruffled" edge or an edge having alternating depressions 82 and elevations 84 with level connecting spaces 86 therebetween. This divider surface may be used with any of the previous shell halves 50, 52 or with shell half 85 (FIG. 41) which contains depressions 82 and ridges or elevations 84 which align with those of divider 54 (FIG. 40) to present points of capture for a cord 17 (not shown) which may be inserted into the cord device. In this manner, a cord end can be placed at a particular location on the outer circumference of the cord holder device and the cord will then be retained in that position due to its frictional capture in a depression 82 or ridge 84.

Figure 42:
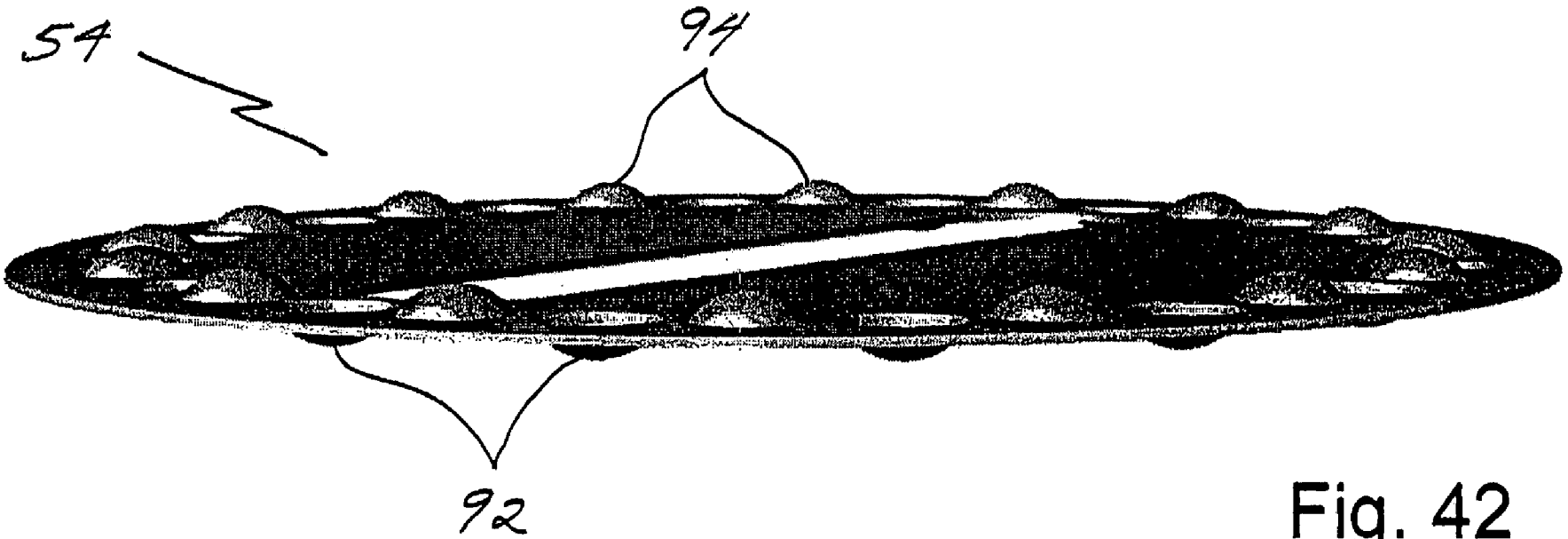
FIG. 42 is an alternate embodiment of the divider having circular bumps and depressions for capturing a cord.
Figure 43:
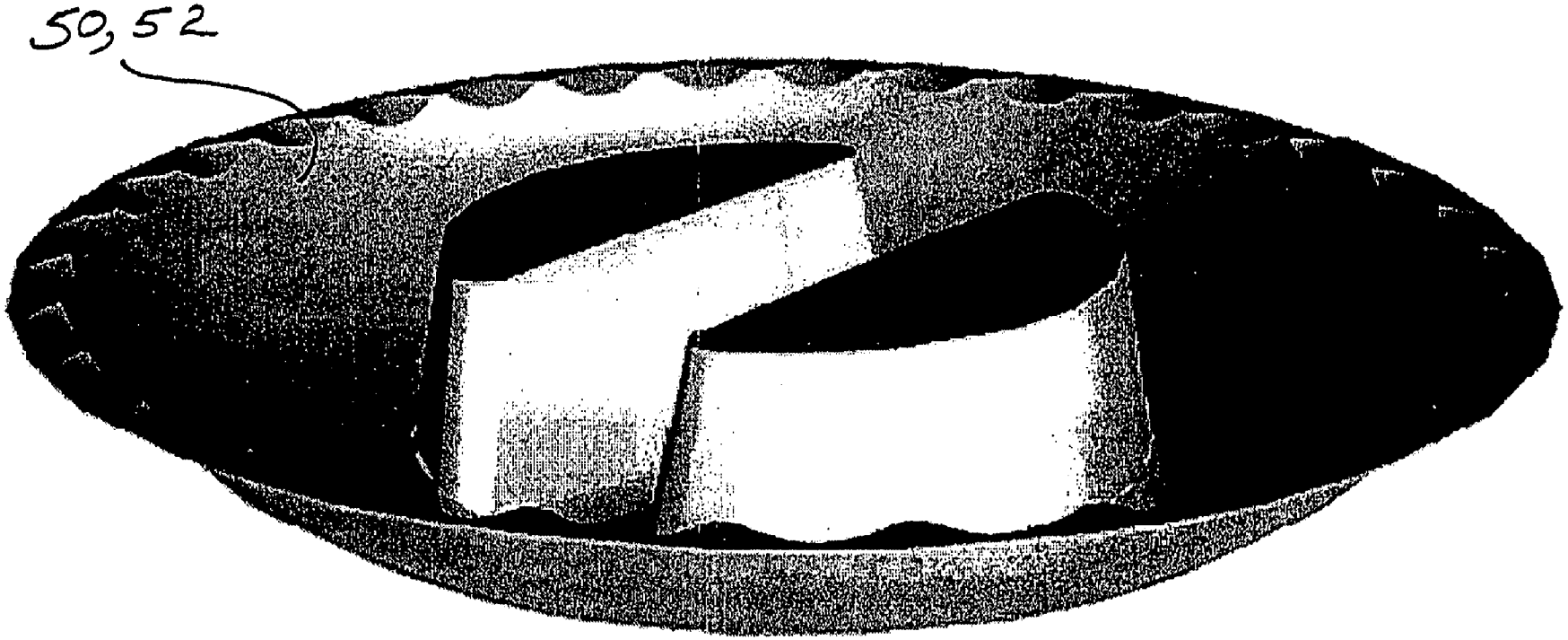
FIG. 43 is an alternate embodiment of a shell half having generally circular depressions for mating with the divider of FIG. 42.

Referring now to FIGS. 42 and 43, an alternate construction of a divider 54 (FIG. 42) and shell halve 50, 52 which may be used in tandem or the divider may be used individually to capture a cord in a particular position along the circumference of the cord holder device. The divider of FIG. 42 is provided with ridges or elevations or circular bumps 94 and depressions 92 which will serve to capture the cord therebetween. Again, it will be appreciated that divider 54 (FIG. 42) may be used in tandem with shell half 50, 52 of FIG. 43 to provide capture of a cord.

Figure 44:
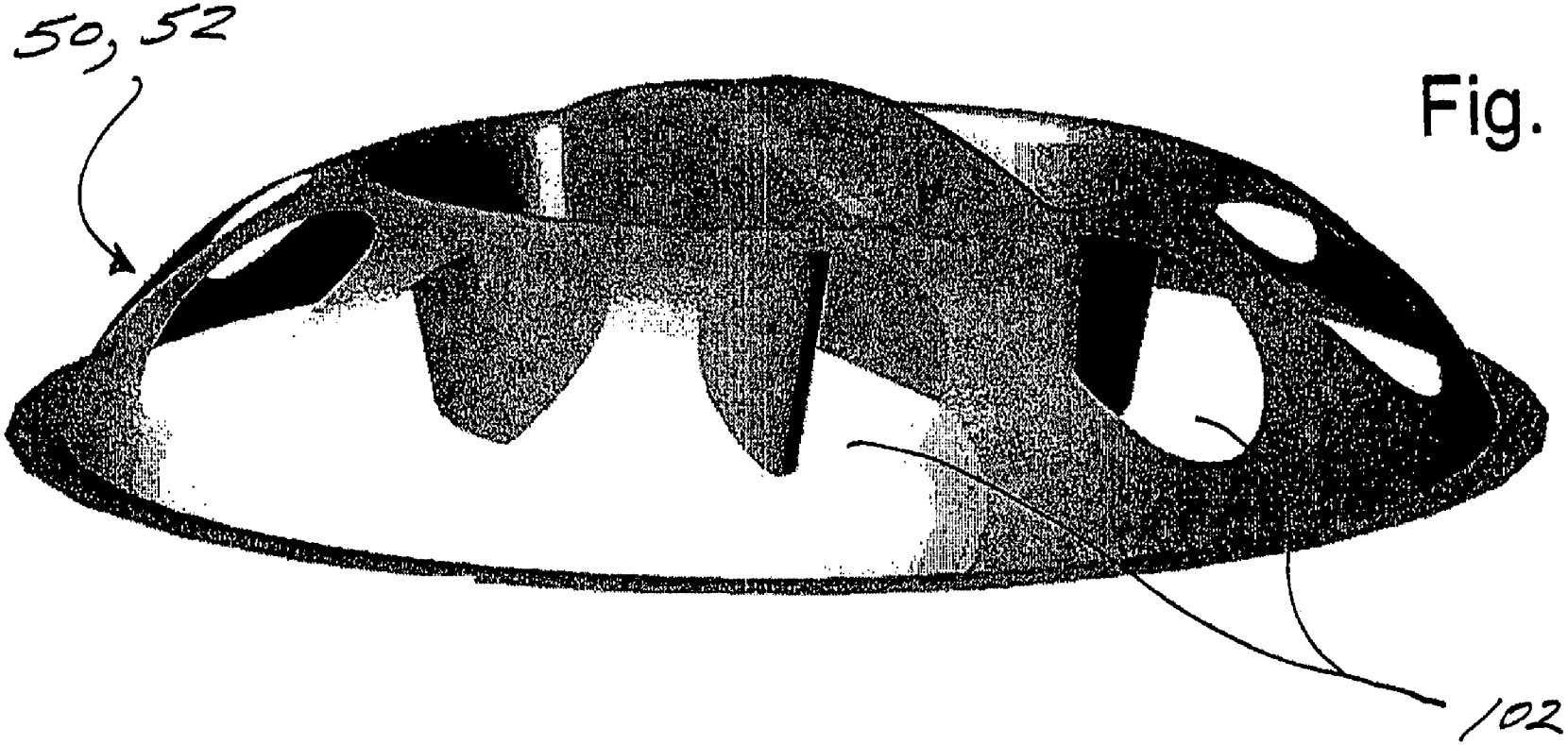
FIG. 44 is a shell half having voids therein to allow air cooling of a cord wound on the cord holder device.

Referring now to FIG. 44, an alternate embodiment of shell half 50, 52 is shown in which the shell half is provided with voids 102 which serve to allow air circulation around a cord stored within shell half 50, 52. It will be appreciated by those skilled in the art that if a lengthy extension cord is wound on the cord holder device of the present invention and a current is passed through it, that heat buildup can occur due to the coiling of the wire in an enclosed space. The addition of air circulation voids 102 can assist in cooling the wire to avoid overheating of the cord and potential for a fire hazard. Further, the air circulation voids 102 increase the flexibility of the shell halves, reduces the weight of the device, and if the shell half is injection molded the amount of material required to form the shell is reduced.

Figure 45A:
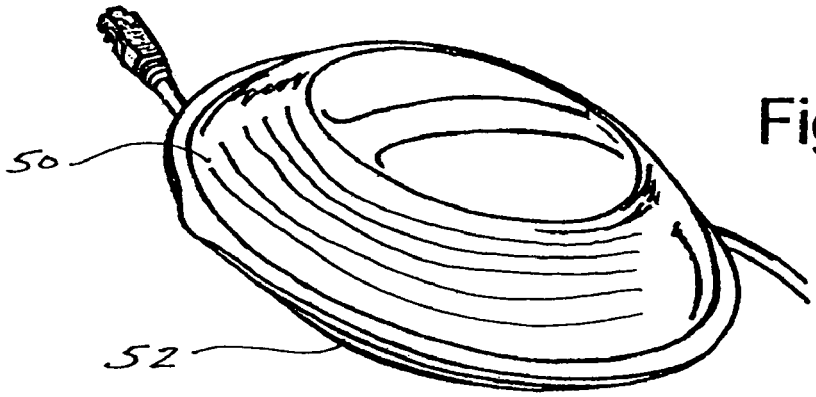
FIGS. 45*a*-45*d* show the inclusion of weakened circumferential ridges to allow easier and complete opening of a shell half 50, 52 for ease of winding a cord on the device.
Figure 45B:
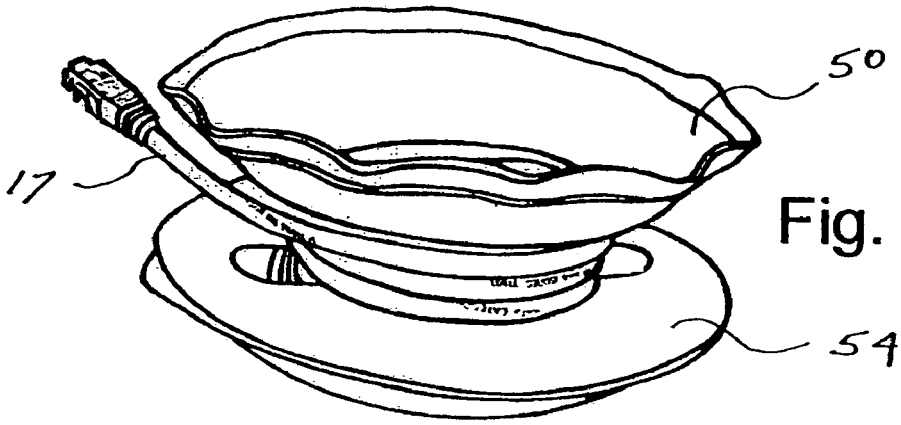
Figure 45C:
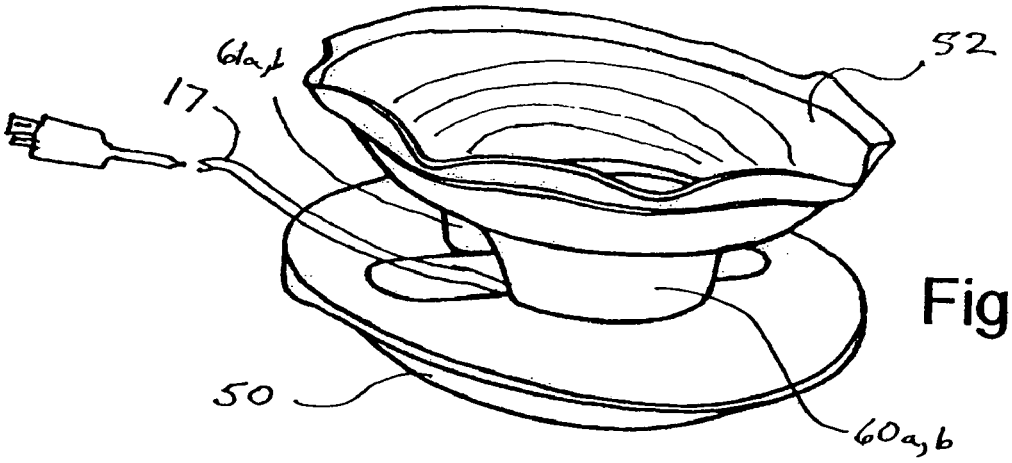
Figure 45D:
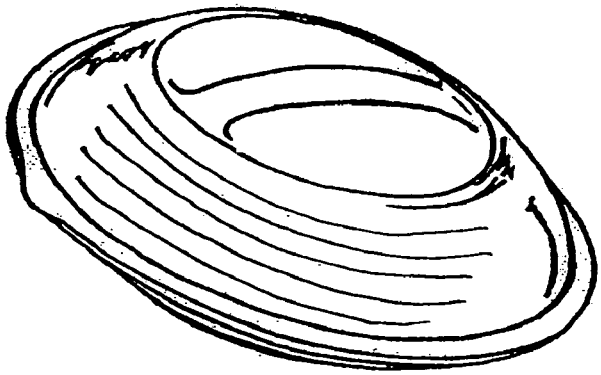
Figure 46:
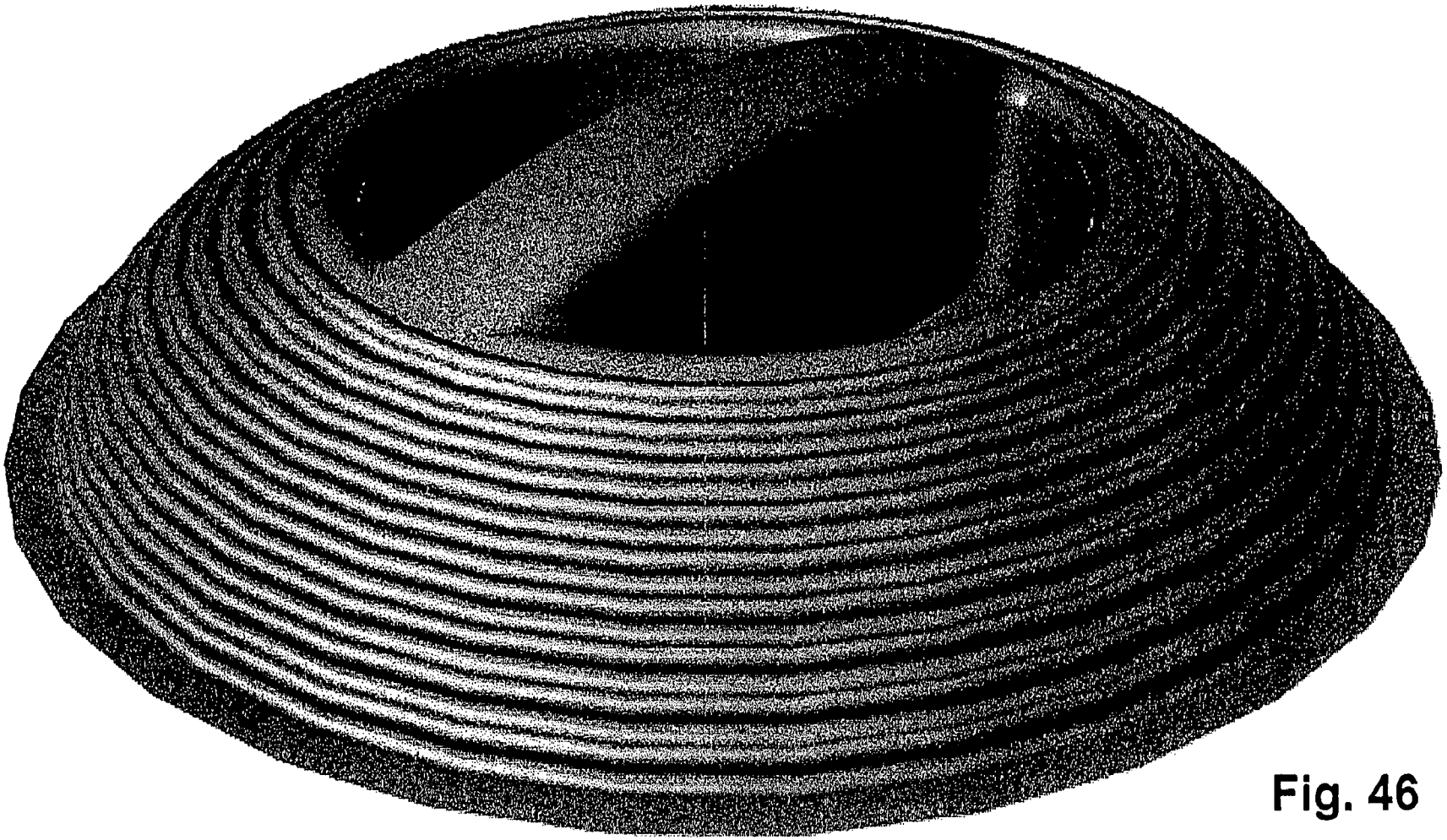
FIG. 46 shows a shell half of the type shown in FIGS. 45*a*-45*d* having circumferential ridges thereon.

Referring now to FIGS. 45*a*-45*d*, a device made according to the present invention is shown wherein the shell halves 50, 52 are provided with circumferential ridges of weakened or thinner material in the construction of shell half 50, 52. This inclusion of weakened circumferential bands on shell halves 50, 52 allow a user to easily flip a shell half 52 or turn the shell half, essentially, inside out as shown in FIG. 45*b*. This reconfiguration of the shell half may be described as a reversal of the convexity of the shell half which permits ease of access to the portion of the shell half that is the interior of the shell half prior to the reversal of the convexity. FIG. 46 shows one shell half of the device of FIGS. 45*a*-45*d* and the circumferential bands thereon. It should be appreciated that embodiments of the shell half which lack the circumferential bands may be flexed open, but that the addition of the circumferential bands eases this process.

This complete opening of shell half 50 can be taken advantage of by the user to ease entry of the cord 17 into the device and the threading of cord 17 through divider 54. Once the user has loaded one side of the cord holder device as shown in FIG. 45*b*, shell half 50 can be closed back down to cover the cord, the device flipped over, and the same procedure followed with shell half 52 wherein the other end of cord 17 is wound about central hub created by hub halves 60*a, b*, and 61*a, b*. Once cord 17 is wound, shell half 52 can be folded back down as shown in FIG. 45*b*, and the cord holder is loaded for use.

Figures 47A, 47B, 47C, 47D, 47E:
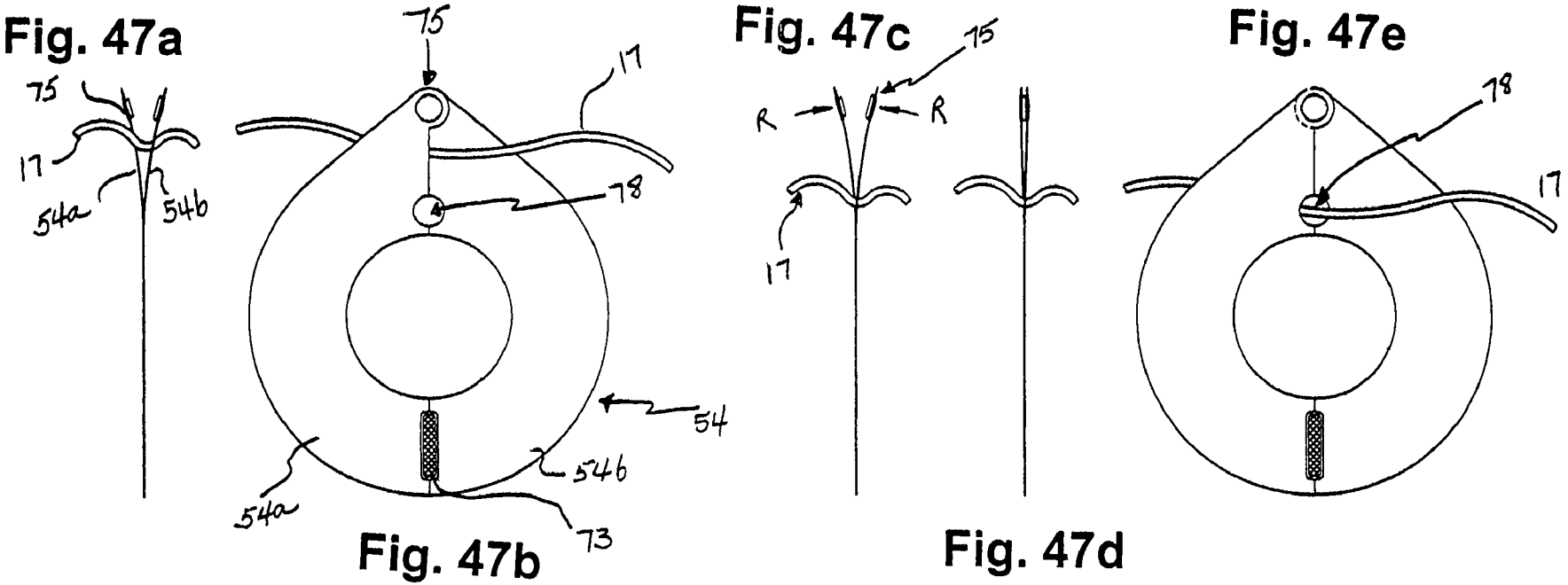
FIGS. 47*a*-47*e* show an embodiment of a divider formed by the mating of two halves and with a portion of a pass-through void in each of the halves and with top and bottom fasteners to capture the cord within the void and to hold the halves together.

Referring now to FIGS. 47*a*-47*e*, an embodiment of the divider 54 is shown comprised of two divider halves, 54*a*, 54*b* (FIG. 47*b*). Divider 54 in this embodiment may be made in two pieces as shown which are then sealed together by fastener 73 which may be any type of fastener or spot wield or adhesive or staple or other fastener. Alternatively, divider 54 may be made as one piece but which is provided with a top fastener portion 75 permitting closure of the two halves of divider 54 once cord 17 is inserted therebetween.

Referring now to FIG. 47*a*, and subsequently to FIGS. 47*b*-47*e*, the loading of a cord 17 into divider 54 of the present embodiment will be described. In FIG. 47*a*, top fastener 75 has been opened to separate the two halves of the divider 54*a*, 54*b* and to allow insertion of a cord 17 therebetween. In FIG. 47*b*, cord 17 is shown inserted between divider halves 54*a*, 54*b* and partially pressed downwardly towards void 78. Void 78 as shown in FIG. 47*b* is partially in divider half 54*a* and partially in divider half 54*b*. Those skilled in the art will appreciate that nearly all of void 78 could be placed in one half 54*a*, 54*b* or the other as was the case for void 20 of the embodiment shown in FIGS. 1-5.

Referring now to 47*c*, it can be seen that cord 17 has been urged downwardly toward void 78 so that cord 17 now resides within void 78. After cord 17 has been positioned within void 78, top fastener 75 may be closed by urging the halves of top fastener 78 into a closed position along the direction shown by arrows "R" of FIG. 47*c* until the fastener 75 is brought together as shown in FIG. 47*d* for closure of divider half 54*a* against divider half 54*b*.

Figure 48B:
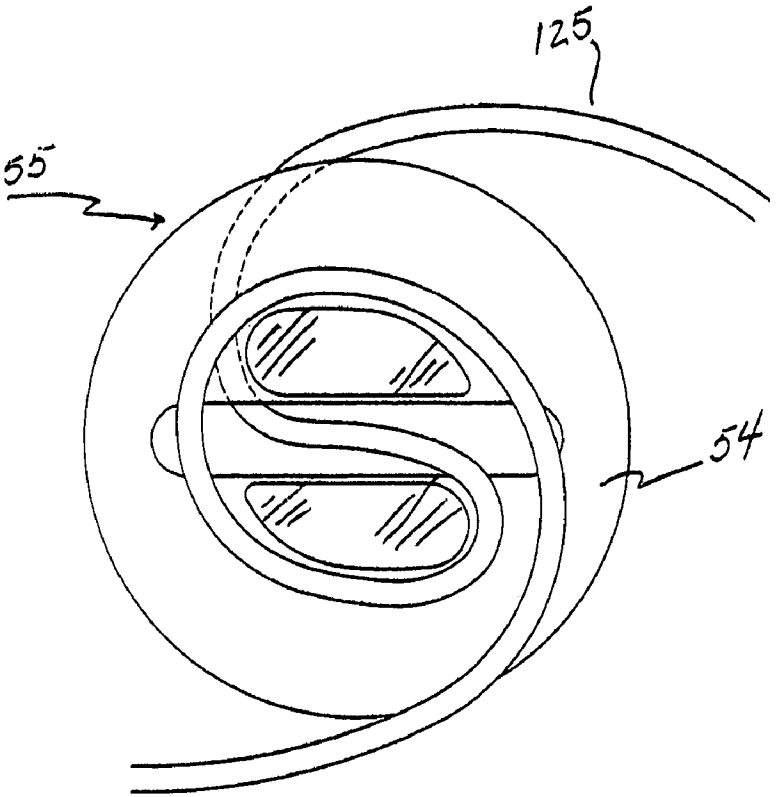
FIGS. 48*a*, 48*b* show an embodiment of a shell half having a central hub having at least one increased hub radius 120 which reduces the crimping of a hollow tube or hose 125 that is inserted into device 55.
Figure 48A:
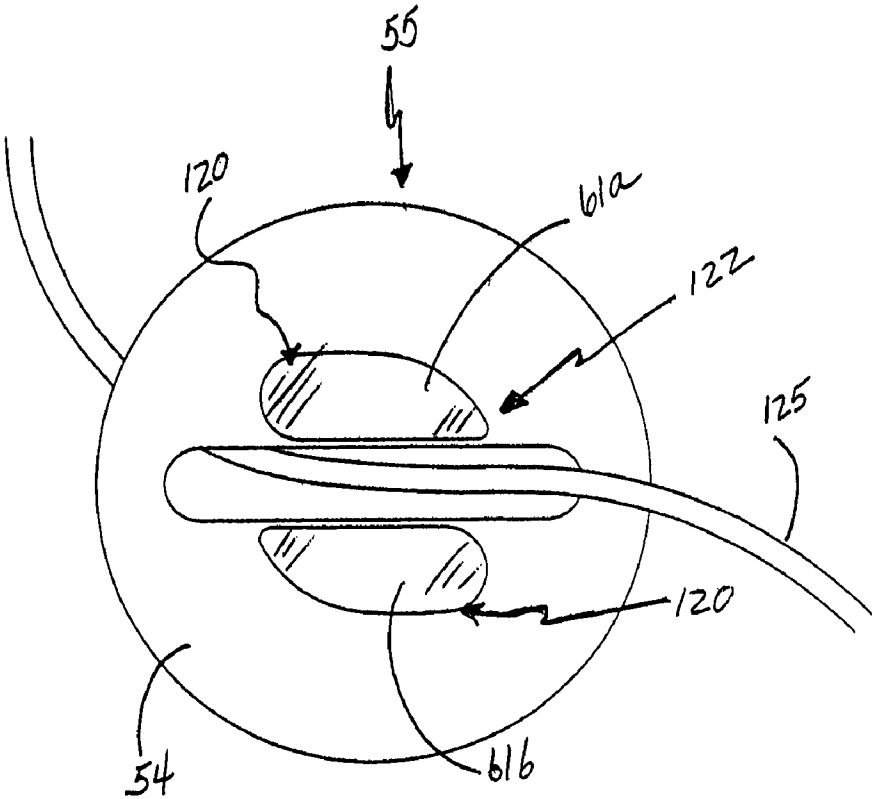
Figure 49:
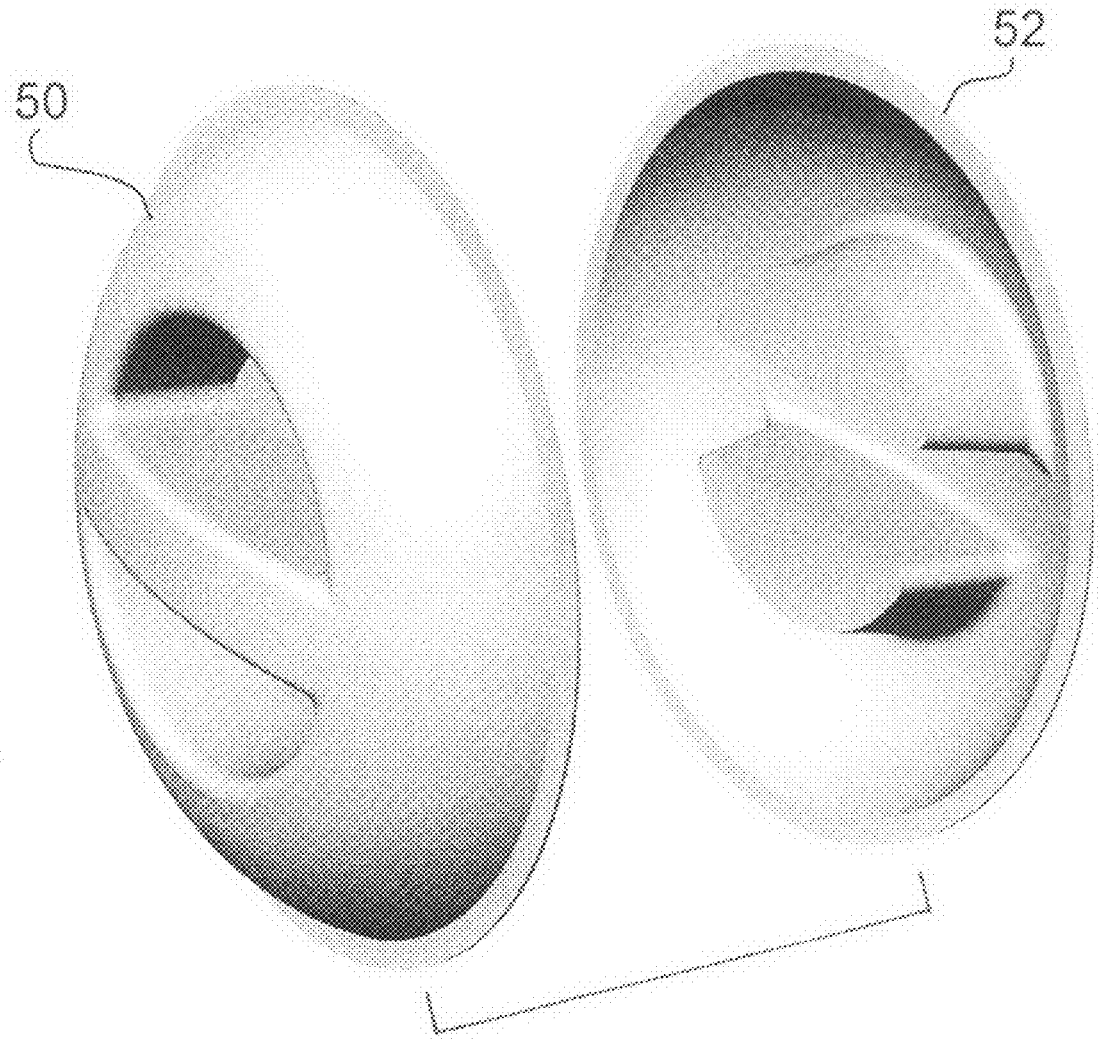
FIG. 49 shows an embodiment, in exploded view, having a central hub having a channel for insertion of a cord therethrough.
Figure 50:
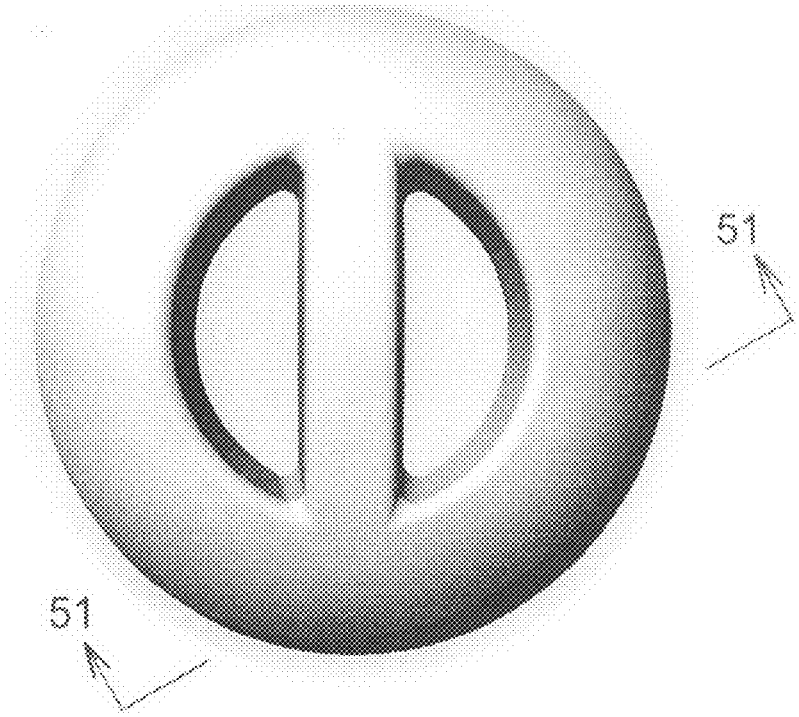
FIG. 50 shows the exterior of one of the shell halves of the embodiment of FIG. 49 in elevation view.
Figure 51:
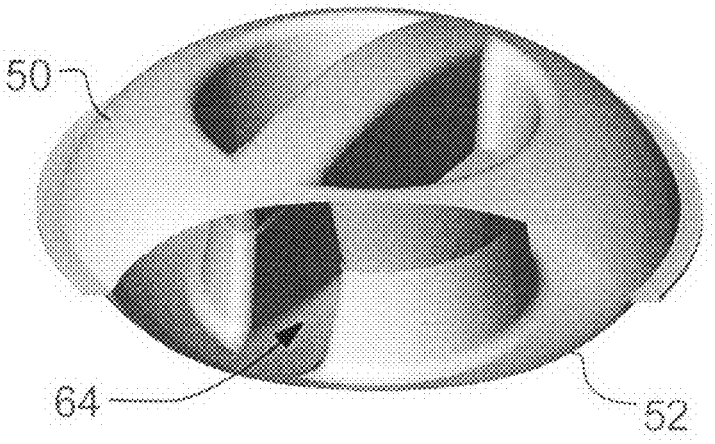
FIG. 51 shows the embodiment of FIGS. 49 and 50 in cross-section view taken along line 51-51 of FIG. 50 and showing the channel 64 passing through the hub.

Referring now to FIGS. 48*a* and 48*b*, a variation of hub halves 60*a*, 60*b* or 61*a*, 61*b* will be described. In the embodiment of FIGS. 48*a*, 48*b*, a cross section along line C-C of FIG. 8 is shown wherein hub halves 61*a*, 61*b* of shell half 50 are shown against divider 54. In the embodiment shown in FIGS. 48*a*, 48*b*, hub halves 61*a*, 61*b* are provided with at least one enlarged radius 120. The enlarged radius 120 of hub halves 61*a*, 61*b* (or 60*a*, 60*b* for the opposite shell half) are provided to avoid forcing hose or tubing 125 about a sharp curve thereby collapsing or crimping hollow hose or tubing 125. It will be appreciated by those skilled in the art that, if hose 125 were wound in the opposite direction from that shown in FIG. 48*b*, that hose 125 would first contact radius 122 shown in FIG. 48*a*. The smaller radius 122 would tend to force hose 125 about a more acute angle thus tending to crimp hose 125 and inhibit the passage of a fluid or gas through hose 125. By using an enlarged radius 120 on hub 61*a*, 61*b*, or 60*a*, 60*b*, and first winding hose or tubing 125 across enlarged radius 120, such crimping of the hose interior will be avoided and fluids and gases may freely pass through hose 125 while hose 125 is wound on device 55.

In the foregoing description, certain terms have been used for brevity, clearness and understanding; but no unnecessary limitations are to be implied therefrom beyond the requirements of the prior art, because such terms are used for descriptive purposes and are intended to be broadly construed and are considered to include all equivalents of the described structure and features. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

It is also to be understood that the following claims are intended to cover all of the generic and specific features of the invention herein described, and all statements of the scope of the invention which, as a matter of language, might be said to fall therebetween.

Having now described the features, discoveries and principles of the invention, the manner in which the improved cord reel and storage device is constructed and used, the characteristics of the construction, and advantageous, new and useful results obtained; the new and useful structures, devices, elements, arrangements, parts and combinations, are set forth in the appended claims.

The invention claimed is:

1. A cord holder device for holding a cord comprising:

a generally donut-shaped shell comprised of first and second shell halves, a generally flat, divider disk for insertion between said shell halves, first and second flaps attached to said disk, said flaps extending outwardly of said shell halves, said first flap having an aperture along an edge abutting said second flap, said aperture being positioned inside of said shell halves, and said second flap edge abutting said aperture to close said aperture, said first and second flaps being separable along said abutting edge to allow insertion of the cord between said abutting edges for insertion of the cord into said aperture.

2. The device as claimed in claim 1 wherein said second flap abutting edge extends to overlap said first flap.

3. The device as claimed in claim 1, said shell half comprising a plurality of voids in the outer wall of said shell half for circulation of air to cool the cord.

4. The device as claimed in claim 1, further comprising a plurality of circumferential lines of weakness on an outer wall of said shell half to permit said shell half convexity to be reversed by a user.

5. The device as claimed in claim 1 further comprising a fastener on said first flap for connecting said first flap to said second flap.

6. A divider for insertion between first and second shell halves of a cord holder device said shell halves forming a donut-shaped cord holder device for a cord and having a hollow channel spanning the donut hole, said divider comprising:

a generally flat disk having first and second sides, a void in the center of the disk, and first and second flaps extending in opposed directions from a perimeter of said void into the hollow channel for directing the cord from said divider first side adjacent the first shell half to said divider second side adjacent the second shell half.

7. The device as claimed in claim 6, said shell half comprising a plurality of voids in the outer wall of said shell half for circulation of air to cool the cord.

8. The device as claimed in claim 6, further comprising a plurality of circumferential lines of weakness on an outer wall of said shell half to permit said shell half convexity to be reversed by a user.

9. A cord holder device for holding a cord comprising:

a generally donut-shaped shell comprised of first and second shell halves, each of said shell halves having a central void therein to form the donut shape, a hollow channel diametrically spanning said central void of said donut shape, the hollow channel having first and second ends in communicative association with said cord storage areas of said shell halves, said channel spanning said central void for communication of the cord therethrough and into each of said cord storage areas, said channel providing a handle for holding said donut-shaped device, and a divider disk for insertion between said shell halves to separate a cord storage area of said first shell half from a cord storage area of said second shell half, said divider presenting cord directing protrusions extending into said channel for directing the cord between said first shell half and said second shell half.

10. The device as claimed in claim 9, said shell half comprising a plurality of voids in the outer wall of said shell half for circulation of air to cool the cord.

11. The device as claimed in claim 9, further comprising a plurality of circumferential lines of weakness on an outer wall of said shell half to permit said shell half convexity to be reversed by a user.

12. A cord holder device for holding a cord comprising:

a generally donut-shaped shell comprised of first and second shell halves, each of said shell halves having a central depression therein to form the donut shape, each of said shell halves presenting a cord storage area therein, a hollow channel, having first and second ends in communicative association with said cord storage areas of said shell halves, said channel spanning said central depression for communication of the cord therethrough and into each of said cord storage areas, and a divider for insertion between said shell halves said divider having a void therein for coaxial alignment with said hollow channel, said void sufficient in size and positioned to allow direct alignment of said cord through both said divider and said channel.

13. The device as claimed in claim 12, said shell half comprising a plurality of voids in the outer wall of said shell half for circulation of air to cool the cord.

14. The device as claimed in claim 12, further comprising a plurality of circumferential lines of weakness on an outer wall of said shell half to permit said shell half convexity to be reversed by a user.

15. The device as claimed in claim 12, wherein said void in said divider is an elongate void coaxially aligned with said hollow channel said void spacing said divider from said first and second ends of said channel to permit insertion of said cord into said channel.

16. A cord holder device for holding a cord comprising:

a generally donut-shaped shell comprised of first and second shell halves, each of said shell halves having a central depression therein to form the donut shape, each of said shell halves presenting a cord storage area therein, said first and second shell halves extending to join to enclose said cord storage area to retain the cord therein, a circumferential slit extending around a circumference of said cord holder device to allow access to said enclosed cord-holding space, and a hollow channel integrally formed in said central depression, said channel having first and second ends connected to said cord storage areas of said shell halves, said channel spanning said central depression for communication of the cord therethrough and into each of said cord storage areas.

* * * * *